US011156944B2

(12) United States Patent
Takeda et al.

(10) Patent No.: US 11,156,944 B2
(45) Date of Patent: Oct. 26, 2021

(54) IMAGE FORMING APPARATUS, IMAGE FORMING METHOD, AND COMPUTER READABLE RECORDING MEDIUM FOR RECORDING PROGRAM

(71) Applicant: CANON KABUSHIKI KAISHA, Tokyo (JP)

(72) Inventors: Isamu Takeda, Machida (JP); Satoshi Nishida, Fujisawa (JP); Atsushi Nakamoto, Tokyo (JP); Takeshi Shinji, Yokohama (JP); Takanori Mitani, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/878,774

(22) Filed: May 20, 2020

(65) Prior Publication Data

US 2020/0371459 A1 Nov. 26, 2020

(30) Foreign Application Priority Data

May 21, 2019 (JP) ..... 2019-095113

(51) Int. Cl.
*G03G 15/20* (2006.01)

(52) U.S. Cl.
CPC ..... *G03G 15/2039* (2013.01); *G03G 15/205* (2013.01); *G03G 15/2028* (2013.01)

(58) Field of Classification Search
CPC ..... G03G 15/2028; G03G 15/2039; G03G 15/6529; G03G 15/205
See application file for complete search history.

(56) References Cited

U.S. PATENT DOCUMENTS

| | | | | |
|---|---|---|---|---|
| 5,289,247 | A * | 2/1994 | Takano | G03G 15/2042 399/45 |
| 8,983,326 | B2 * | 3/2015 | Takeuchi | G03G 15/2046 399/69 |
| 9,091,974 | B2 * | 7/2015 | Yoshioka | G03G 15/5041 |
| 9,104,153 | B2 * | 8/2015 | Imamiya | G03G 15/2064 |
| 10,067,448 | B2 | 9/2018 | Nishida et al. | |
| 2012/0114358 | A1 * | 5/2012 | Sugiyama | G03G 15/2039 399/69 |
| 2018/0074445 | A1 * | 3/2018 | Nishida | G03G 15/2028 |

FOREIGN PATENT DOCUMENTS

| | | |
|---|---|---|
| JP | 2004-191853 A | 7/2004 |
| JP | 2006-154413 A | 6/2006 |
| JP | 2009-092688 A | 4/2009 |
| JP | 2017-151323 A | 8/2017 |

* cited by examiner

*Primary Examiner* — Hoang X Ngo
(74) *Attorney, Agent, or Firm* — Venable LLP

(57) ABSTRACT

An image forming apparatus, including: a fixing, onto a recording material, a toner image that is formed in accordance with image data, and constituted of a first image that is formed by a toner of a first color and a second image that is formed by a toner of a second color which is different from the first color, and that is superimposed on the first image; an acquiring a gradation value of the first image and a gradation value of the second image based on the image data; a determining a target temperature and target speed based on the gradation value of the first image and the gradation value of the second image; a controlling power to be supplied to the fixing unit based on the target temperature; and a controlling conveying speed of the recording material based on the target speed.

21 Claims, 21 Drawing Sheets

FIG.8A

TONER LAYER CONFIGURATION (A)

| | TONER CHARACTERISTIC VALUE | GRADATION VALUE | SEPARATION INDEX OF EACH COLOR |
|---|---|---|---|
| Y | 2.7 | 80% | 2.16 |
| M | 3.0 | 80% | 2.40 |
| C | 3.6 | 0% | 0.00 |
| K | 4.3 | 0% | 0.00 |
| | | SEPARATION INDEX S1 | **4.56** |

FIG.8B

TONER LAYER CONFIGURATION (B)

| | TONER CHARACTERISTIC VALUE | GRADATION VALUE | SEPARATION INDEX OF EACH COLOR |
|---|---|---|---|
| Y | 2.7 | 0% | 0.00 |
| M | 3.0 | 80% | 2.40 |
| C | 3.6 | 80% | 2.88 |
| K | 4.3 | 0% | 0.00 |
| | | SEPARATION INDEX S1 | **5.28** |

FIG.14A

TONER LAYER CONFIGURATION (A)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 80% | 0% | 2.16 |
| M | 3.0 | 0% | 0% | 0.00 |
| C | 3.6 | 0% | 0% | 0.00 |
| K | 4.3 | 40% | 40% | 1.72 |
| | | | SEPARATION INDEX S1 | **3.88** |

FIG.14B

TONER LAYER CONFIGURATION (B)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 40% | 40% | 1.08 |
| M | 3.0 | 0% | 0% | 0.00 |
| C | 3.6 | 0% | 0% | 0.00 |
| K | 4.3 | 80% | 0% | 3.44 |
| | | | SEPARATION INDEX S1 | **4.52** |

FIG.16A

IMAGE (A)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 25% | 0% | 0.68 |
| M | 3.0 | 25% | 0% | 0.75 |
| C | 3.6 | 25% | 0% | 0.90 |
| K | 4.3 | 25% | 0% | 1.08 |
| | | | SEPARATION INDEX S1 | **3.41** |

FIG.16B

IMAGE (B)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 0% | 0% | 0.00 |
| M | 3.0 | 0% | 0% | 0.00 |
| C | 3.6 | 0% | 0% | 0.00 |
| K | 4.3 | 0% | 0% | 0.00 |
| | | | SEPARATION INDEX S1 | **0.00** |

FIG.16C

IMAGE (C)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 80% | 0% | 2.16 |
| M | 3.0 | 40% | 40% | 1.20 |
| C | 3.6 | 0% | 0% | 0.00 |
| K | 4.3 | 0% | 0% | 0.00 |
| | | | SEPARATION INDEX S1 | **3.36** |

*FIG.16D*

IMAGE (D)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 0% | 0% | 0.00 |
| M | 3.0 | 0% | 0% | 0.00 |
| C | 3.6 | 0% | 0% | 0.00 |
| K | 4.3 | 0% | 0% | 0.00 |
| | | | SEPARATION INDEX S1 | **0.00** |

*FIG.16E*

IMAGE (E)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 0% | 0% | 0.00 |
| M | 3.0 | 0% | 0% | 0.00 |
| C | 3.6 | 80% | 0% | 2.88 |
| K | 4.3 | 40% | 40% | 1.72 |
| | | | SEPARATION INDEX S1 | **4.60** |

FIG.17A

TONER LAYER CONFIGURATION (A)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 80% | 0% | 2.16 |
| M | 3.0 | 0% | 0% | 0.00 |
| C | 3.6 | 0% | 0% | 0.00 |
| K | 4.3 | 40% | 40% | 2.15 |
| | | | SEPARATION INDEX S1 | **4.31** |

FIG.17B

TONER LAYER CONFIGURATION (B)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 40% | 40% | 1.35 |
| M | 3.0 | 0% | 0% | 0.00 |
| C | 3.6 | 0% | 0% | 0.00 |
| K | 4.3 | 80% | 0% | 3.44 |
| | | | SEPARATION INDEX S1 | **4.79** |

FIG.19A

IMAGE (A)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 25% | 0% | 0.68 |
| M | 3.0 | 25% | 0% | 0.75 |
| C | 3.6 | 25% | 0% | 0.90 |
| K | 4.3 | 25% | 0% | 1.08 |
| | | | SEPARATION INDEX S2 | **3.41** |

FIG.19B

IMAGE (B)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 0% | 0% | 0.00 |
| M | 3.0 | 0% | 0% | 0.00 |
| C | 3.6 | 0% | 0% | 0.00 |
| K | 4.3 | 0% | 0% | 0.00 |
| | | | SEPARATION INDEX S2 | **0.00** |

FIG.19C

IMAGE (C)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 80% | 0% | 2.16 |
| M | 3.0 | 40% | 40% | 1.50 |
| C | 3.6 | 0% | 0% | 0.00 |
| K | 4.3 | 0% | 0% | 0.00 |
| | | | SEPARATION INDEX S2 | **3.66** |

FIG.19D

IMAGE (D)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 0% | 0% | 0.00 |
| M | 3.0 | 0% | 0% | 0.00 |
| C | 3.6 | 0% | 0% | 0.00 |
| K | 4.3 | 0% | 0% | 0.00 |
| | | | SEPARATION INDEX S2 | **0.00** |

FIG.19E

IMAGE (E)

| | TONER CHARACTERISTIC VALUE | UPPER LAYER GRADATION VALUE | LOWER LAYER GRADATION VALUE | SEPARATION INDEX OF EACH COLOR |
|---|---|---|---|---|
| Y | 2.7 | 0% | 0% | 0.00 |
| M | 3.0 | 0% | 0% | 0.00 |
| C | 3.6 | 80% | 0% | 2.88 |
| K | 4.3 | 40% | 40% | 2.15 |
| | | | SEPARATION INDEX S2 | **5.03** |

IMAGE FORMING APPARATUS, IMAGE FORMING METHOD, AND COMPUTER READABLE RECORDING MEDIUM FOR RECORDING PROGRAM

BACKGROUND OF THE INVENTION

Field of the Invention

The present invention relates to an image forming apparatus, such as an electrophotographic copier and an electrophotographic printer, an image forming method, and a program.

Description of the Related Art

In a conventional image forming apparatus using an electrophotographic process, a toner image formed on a photosensitive member is transferred onto a recording material, and is then transferred onto a recording medium by passing through a fixing apparatus (image heating apparatus), whereby the toner image is fixed on the recording material.

In the fixing apparatus, an unfixed toner image formed on the recording material is contact-heated by a fixing member, which is heated at a predetermined target temperature (fixing temperature) by a heating member, so as to fix the toner image as a fixed image. At this time, the unfixed toner image on the recording material is in a melted state due to the contact-heating, but if the toner is excessively melted, a fixing-separation failure, that is, a state of the recording material not separating from the fixing member, may occur.

Particularly in the case of printing the toner image in two layers, three layers or the like using a plurality of colors, a high heat amount is required to melt the toner, and the amount of melted toner that comes into contact with the fixing member is high. This increases the attachment force of the toner, and more easily causes a fixing-separation failure.

A method of preventing the fixing-separation failure is to decrease a conveying speed (processing speed) of the recording material by a fixing member of the fixing apparatus, so as to increase the time for the recording material to pass through a fixing nip of the fixing apparatus. Increasing the time for the recording material to pass through the fixing nip allows the toner image to be fixed at a relatively low temperature. Therefore, an unnecessary heat amount can be suppressed and the toner image can be fixed to the recording material without entering into an excessively melted state.

However decreasing the processing speed drops printing productivity. In order to minimize the drop in printing productivity, an optimum heat amount, which allows the toner image to be fixed and the recording material to be separated from the fixing member, must be supplied to the toner in accordance with the image to be printed. Japanese Patent Application Publication No. 2006-154413 discloses a technique to control the fixing temperature in accordance with the layer thickness of the toner. Further, Japanese Patent Application Publication No. 2009-92688 discloses a technique to control the fixing temperature in accordance with the image data amount.

SUMMARY OF THE INVENTION

In the case where a toner image is constituted of a plurality of colors of toner layers, the fixing-separation may also depend on the layer configuration of the toner image.

This is because a plurality of colors of toner influences the fixing-separation differently depending on the color, which is due to the difference of such components as colorants. However, in the case of the conventional control based on the layer thickness of the toner and the image data amount, the processing speed reduction mode may be selected to prevent the fixing-separation failure, even under the conditions where the fixing-separation failure does not occur. With the foregoing in view, it is an object of the present invention to appropriately control the fixing unit in accordance with the layer configuration of a toner image constituted of a plurality of colors of toner layers.

In order to achieve the object described above, an image forming apparatus, including:

a fixing unit configured to fix, onto a recording material, a toner image that is formed in accordance with image data, and constituted of a first image that is formed by at least a toner of a first color and a second image that is formed by a toner of a second color which is different from the first color, and that is superimposed on the first image;

an acquiring unit configured to acquire at least information on a gradation value of the first image and information on a gradation value of the second image based on the image data;

a determining unit configured to determine a target temperature which is a temperature to fix the toner image to the recording material and target speed to convey the recording material, based on the information on the gradation value of the first image and the information on the gradation value of the second image; and a control unit configured to control power to be supplied to the fixing unit so that the temperature of the fixing unit maintains the target temperature, and to control conveying speed of the recording material, which is conveyed by the fixing unit based on the target speed.

In order to achieve the object described above, an image forming method for an image forming apparatus including a fixing unit configured to fix, onto a recording material, a toner image that is formed in accordance with image data, and constituted of a first image that is formed by at least a toner of a first color and a second image that is formed by toner of a second color which is different from the first color, and that is superimposed on the first image, wherein a computer executes:

an acquiring step of acquiring at least information on a gradation value of the first image and information on a gradation value of the second image based on the image data;

a determining step of determining target temperature, which is a temperature to fix the toner image to the recording material, and target speed to convey the recording material, based on the information on the gradation value of the first image and the information on the gradation value of the second image; and a control step of controlling power to be supplied to the fixing unit so that the temperature of the fixing unit maintains the target temperature, and controlling conveying speed of the recording material, which is conveyed by the fixing unit, based on the target speed.

According to the present invention, the fixing unit can be appropriately controlled in accordance with the layer configuration of a toner image constituted of a plurality of colors of toner layers.

Further features of the present invention will become apparent from the following description of exemplary embodiments with reference to the attached drawings.

BRIEF DESCRIPTION OF THE DRAWINGS

FIG. 8A is a table indicating a separation index of each toner layer configuration of an image according to Embodiment 1;

FIG. 8B is a table indicating a separation index of each toner layer configuration of an image according to Embodiment 1;

FIG. 14A is a table indicating a separation index of each toner layer configuration of an image according to Embodiment 2;

FIG. 14B is a table indicating a separation index of each toner layer configuration of an image according to Embodiment 2;

FIGS. 16A to 16E indicate gradation value information and separation index of images according to Embodiment 2;

FIG. 17A is a table indicating a separation index of each toner layer configuration of an image according to Embodiment 3;

FIG. 17B is a table indicating a separation index of each toner layer configuration of an image according to Embodiment 3;

FIGS. 19A to 19E indicate gradation value information and separation index of images according to Embodiment 3.

DESCRIPTION OF THE EMBODIMENTS

Embodiments of the present invention will be described with reference to the drawings. Dimensions, materials, shapes and relative positions of components described below in the embodiments should be appropriately changed depending on the configurations and various conditions of the apparatus to which the invention is applied, and therefore are not intended to limit the scope of the invention to the following embodiments.

Embodiment 1

1-1 Image Forming Apparatus

Figure 1:
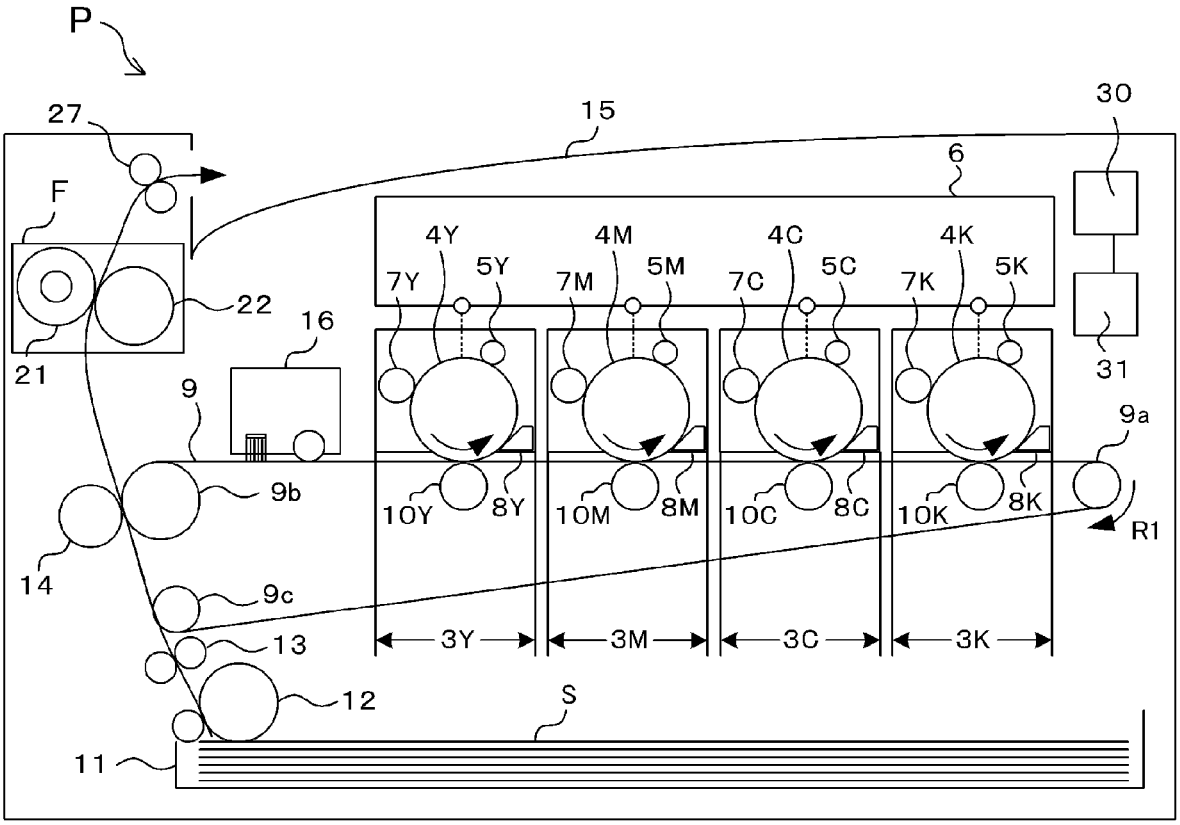
FIG. 1 is a cross-sectional view depicting a general configuration of an image forming apparatus according to Embodiment 1.

An image forming apparatus according to an embodiment will be described. FIG. 1 is a cross-sectional view depicting a general configuration of an image forming apparatus P according to Embodiment 1. The image forming apparatus P includes four image forming stations 3Y, 3M, 3C and 3K, which are arrayed roughly in a line. Out of the four image forming stations 3Y, 3M, 3C and 3K, the image forming station 3Y forms a yellow (hereafter Y) color image. The image forming station 3M forms a magenta (hereafter M) color image. The image forming station 3C forms a cyan (hereafter C) color image. The image forming station 3K forms a black (hereafter K) color image.

Each image forming station 3Y, 3M, 3C or 3K includes a drum type electrophotographic photosensitive member (hereafter photosensitive drum) 4Y, 4M, 4C or 4K which functions as an image bearing member, and a charging roller 5Y, 5M, 5C or 5K which functions as a charging unit. Each image forming station 3Y, 3M, 3C or 3K also includes an exposure apparatus 6 which functions as an exposure unit, developing apparatus 7Y, 7M, 7C or 7K which functions as a developing unit, and a cleaning apparatus 8Y, 8M, 8C or 8K which functions as a cleaning unit.

When image information is received from an external apparatus (not illustrated), such as a host computer, a video controller 30 transmits a print signal to a controller 31 which is a control unit, and starts the image forming operation. When an image is formed, the controller 31 controls the rotation of the photosensitive drum 4Y of the image forming station 3Y via a rotation controller (drive control unit), which is not illustrated, responding to the print instruction (print signal). Thereby the photosensitive drum 4Y of the image forming station 3Y rotates in the arrow direction. The rotation of a photosensitive drum 4Y of the image forming station 3Y may be controlled by the rotation control unit (not illustrated). The controller 31 includes such devices as a ROM, RAM and CPU.

First the outer peripheral surface (surface) of the photosensitive drum 4Y is uniformly charged by the charging roller 5Y. Then the exposure apparatus 6 irradiates the surface (charged surface) of the photosensitive drum 4Y with laser light in accordance with the image data, thereby the surface of the photosensitive drum 4Y is exposed, and an electrostatic latent image is formed on the surface of the photosensitive drum 4Y. The developing apparatus 7Y visualizes the electrostatic latent image formed on the surface of the photosensitive drum 4Y using Y toner. Thereby a Y toner image is formed on the surface of the photosensitive drum 4Y. The same image forming processing is performed in the image forming stations 3M, 3C and 3K as well. As a consequence, an M toner image is formed on the surface of the photosensitive drum 4M, a C toner image is formed on the surface of the photosensitive drum 4C, and a K toner image is formed on the surface of the photosensitive drum 4K respectively.

An endless intermediate transfer belt 9, which is installed along the array direction of the image forming stations 3Y, 3M, 3C and 3K, is stretched by a driver roller 9*a*, a driven roller 9*b* and a driven roller 9*c*. The driver roller 9*a* rotates in the arrow R1 direction in FIG. 1, responding to the print instruction from the rotation controller (drive control unit), which is not illustrated. Thereby the intermediate transfer belt 9 rotationally moves at a 150 mm/sec speed along each image forming station 3Y, 3M, 3C and 3K.

Each color image (toner layer) is superimposedly transferred to the outer peripheral surface (front surface) of the intermediate transfer belt 9 in sequence by the primary transfer units 10Y, 10M, 10C and 10K which face the photosensitive drums 4Y, 4M, 4C and 4K respectively via the intermediate transfer belt 9. For example, an M color image (M toner layer formed by the M color toner) is superimposed on a Y color image (Y toner image) formed by the Y color toner. As a consequence, a full color toner image using the four colors is formed on the surface of the intermediate transfer belt 9.

Untransferred toner remaining on each surface of the photosensitive drums 4Y, 4M, 4C and 4K after primary transfer is removed by a cleaning blade (not illustrated) disposed on each cleaning apparatus 8Y, 8M, 8C and 8K. Then the photosensitive drum 4 (4Y, 4M, 4C, 4K) are ready for the next image.

Recording material S, which is stacked and stored in a paper feeding cassette 11, which is disposed in the lower part of the image forming apparatus P, is fed by a paper feeding roller 12, one-by-one, from the paper feeding cassette 11 to a resist roller pair 13. The resist roller pair 13 transports the fed recording material S to a transfer nip unit between the intermediate transfer belt 9 and a secondary transfer roller 14. The secondary transfer roller 14 is disposed so as to face the driven roller 9*b* via the intermediate transfer belt 9.

Bias is applied to the secondary transfer roller 14 from a high voltage power supply (not illustrated) when the recording material S passes though the transfer nip unit. Then the full color toner image is secondarily transferred from the surface of the intermediate transfer belt 9 to the recording material S, which is passing through the transfer nip unit. The recording material S bearing the toner image is conveyed to the fixing apparatus (fixing unit) F. The recording material S is heated and pressed while passing through the fixing apparatus F, whereby the toner image is heated and fixed onto the recording material S. The recording material S is then delivered from the fixing apparatus F to a paper delivery tray 15 outside the image forming apparatus P by a paper delivery roller 27.

Untransferred toner remaining on the surface of the intermediate transfer belt 9 after the secondary transfer is removed by an intermediate transfer belt cleaning apparatus 16. Then the intermediate transfer belt 9 is ready for the next image formation.

In the image forming apparatus P of Embodiment 1, the peripheral speed (processing speed) of the fixing apparatus F and the resist roller pair 13 is approximately the same as the peripheral velocity of the intermediate transfer belt 9 and the secondary transfer roller 14 in the secondary transfer. Therefore in the case where the controller 31 controls the processing speed via the rotation controller (drive control unit), which is not illustrated, the peripheral speed of the fixing apparatus F and the resist roller pair 13, and of the intermediate transfer belt 9 and the secondary transfer roller 14 in the secondary transfer control, are controlled to be approximately the same speed respectively as well.

1-2 Fixing Apparatus

The fixing apparatus F, which functions as a fixing unit of a toner image, will be described. The fixing apparatus F fixes a toner image, which is formed in accordance with the image data, to a recording material S. In the following description, a longer direction of the fixing apparatus F and composing elements constituting the fixing apparatus F is a direction orthogonal to the conveying direction of the recording material S on the surface of the recording material S, and the shorter direction thereof is a direction parallel with the conveying direction of the recording material S on the surface of the recording material S. The "width" is the dimension in the shorter direction. The "longer width" is a dimension in the direction orthogonal to the conveying direction of the recording material S on the surface of the recording material S. In the following, the conveying direction of the recording material S is referred to as the conveying direction. The conveying direction is a direction matching with the sub-scanning direction, which is orthogonal to the main scanning direction of the image data.

Figure 2:
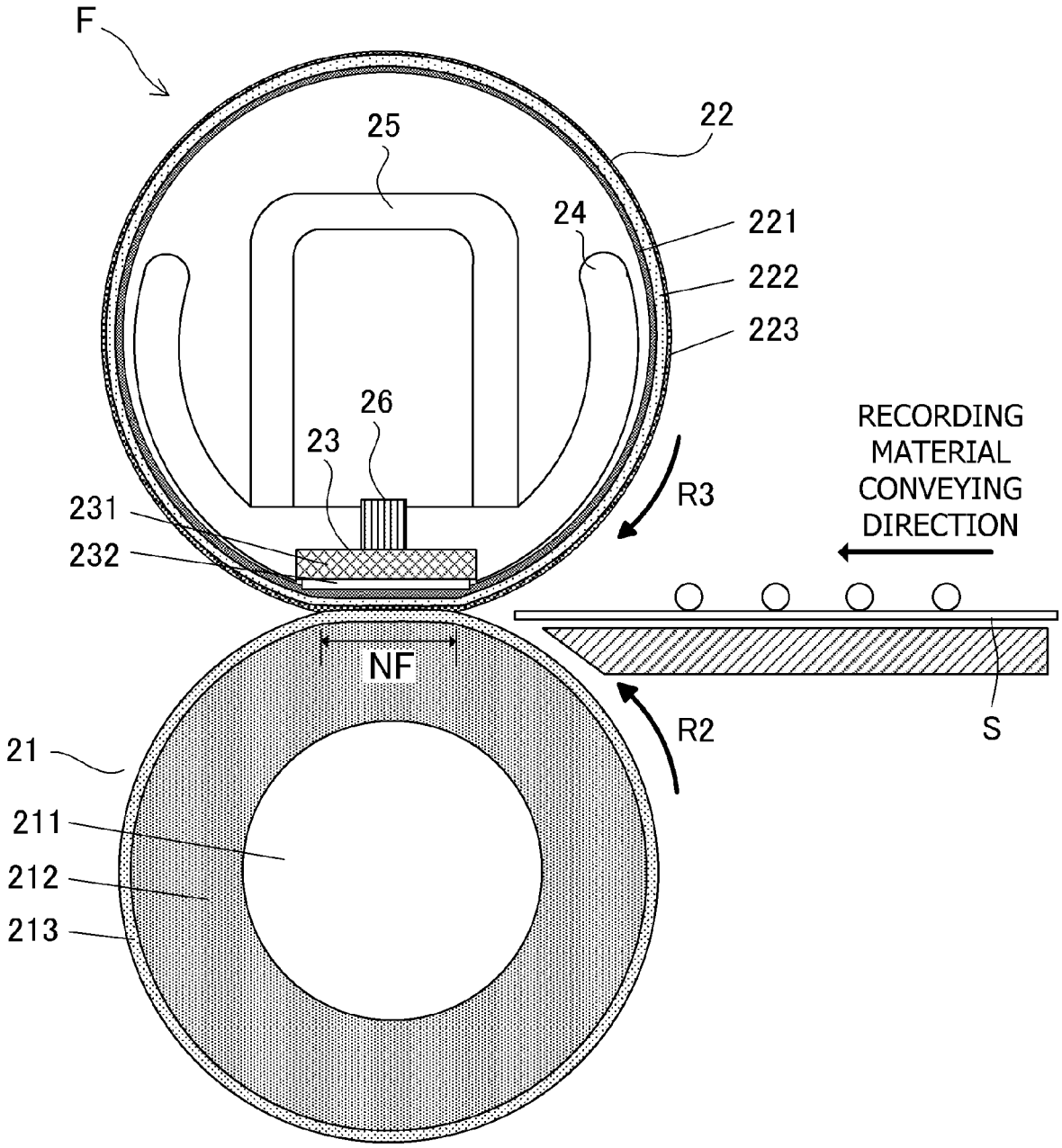
FIG. 2 is a cross-sectional view depicting a configuration of a fixing apparatus according to Embodiment 1.

FIG. 2 is a transverse-sectional view of the fixing apparatus F. The fixing apparatus F is a film heating type or pressing roller driving type tensionless apparatus. In the fixing apparatus F, a pressing roller (pressing member) 21 is rotary driven by a rotation controller (drive control unit), which is not illustrated, in accordance with the print instruction, and a fixing film (fixing member) 22 is rotated by the conveying force of the pressing roller 21. The fixing apparatus F of Embodiment 1 includes the pressing roller (pressing rotating member) 21, a fixing film (fixing rotating member) 22, a heater (heating element) 23, a heater holder (heating element holding member) 24 and a rigid stay (rigid member) 25. The pressing roller 21, the fixing film 22, the heater 23, the heater holder 24 and the rigid stay 25 are all members that are elongated in the longer direction.

The heater 23 has a ceramic substrate 231 that has heat resistance, insulation and good thermal conductivity, and is elongated in the longer direction. At the center on the front surface side (pressing roller 21 side) of the substrate 231 in the shorter direction, a resistant heating element (not illustrated) is formed along the longer direction of the substrate. A power feed electrode (not illustrated), to feed power to the resistance heating element, is disposed on the inner side of each end of the substrate 231 in the longer direction. A heat-resistant overcoat layer 232 is disposed on the front surface side of the substrate 231, so as to cover the surface of the resistance heating element (not illustrated).

Figure 3:
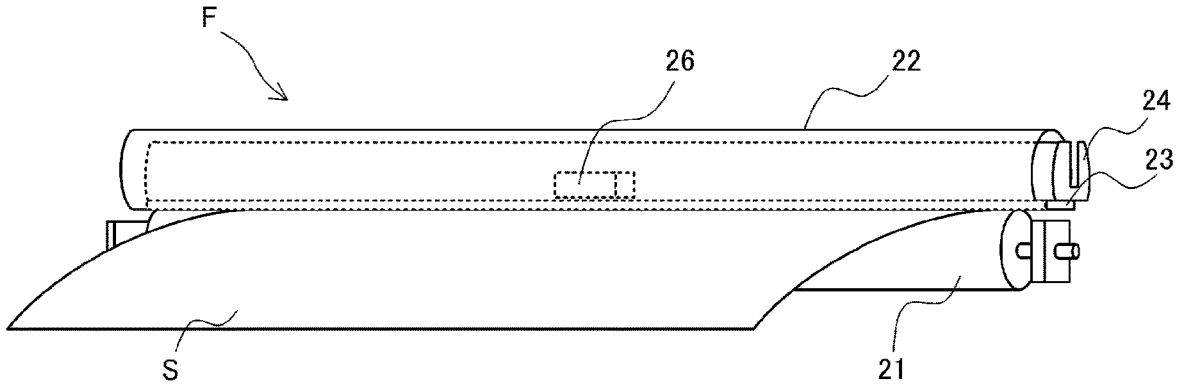
FIG. 3 is a longitudinal perspective view depicting the fixing apparatus according to Embodiment 1.

FIG. 3 is a longitudinal perspective view of the fixing apparatus F. A heater holder 24 is formed of liquid crystal polymer which has heat resistance and rigidity. The heater holder 24 is formed to have an approximately semicircular bucket shape in the transverse sectional view. At the center of the lower surface of the heater holder 24 in the width direction, a groove is formed along the longer direction. In the state where the substrate 231 of the heater 23 is fixed, the overcoat layer 232 of the heater 23 is exposed from the groove of the heater holder 24.

A fixing film 22 is formed of a heat resistance resin having flexibility so as to form a cylindrical shape. The outer peripheral length of the fixing film 22 is 57 mm. The fixing film 22 includes a cylindrical base layer 221, an elastic layer 222 which is formed on the outer periphery of the base layer 221, and a release layer 223 which is formed on the outer periphery of the elastic layer 222. The base layer 221 is formed of a 50 μm thick polyimide layer. The elastic layer 222 is formed of a 200 μm thick silicon rubber. The release layer 223 is formed of a 15 μm thick fluororesin. The inner peripheral length of the fixing film 22 is 3 mm longer than the outer peripheral length of the heater holder 24 holding the heater 23. The fixing film 22 has a longer peripheral length than the heater holder 24, so as to be loosely inserted around the heater holder 24. In other words, the fixing film 22 encloses the heater 23.

The rigid stay 25 is formed of a rigid member having an inverted U shape in the transverse-sectional view. The rigid stay 25 is disposed at the center of the upper surface of the heater holder 24 in the shorter direction. The pressing roller 21 includes a round shaft-shaped core metal 211, an elastic layer 212 which is formed on the outer periphery of the core metal 211, and a release layer 213 which is formed around the elastic layer 212. The elastic layer 212 is formed of a silicon rubber, so as to be concentrically integrated with the core metal 211. The release layer 213 is formed of a conductive fluororesin. The outer peripheral length of the pressing roller 21 is 63 mm. The elastic layer 212 may be formed of a heat resistant rubber (e.g. fluororubber) or a silicon rubber foam. The release layer 213 may be formed of an insulating fluororesin.

The pressing roller 21 faces the fixing film 22. The pressing roller 21 is disposed below the fixing film 22, so as to be parallel with the fixing film 22, and is rotatably held by both ends of the core metal 211 in the longer direction via bearing members. The core metal 211 of the pressing roller 21 and the rigid stay 25 are pressed at both ends in the longer direction by pressing springs (not illustrated) so that the outer peripheral surface (surface) of the pressing roller 21 and the outer peripheral surface (surface) of the fixing film 22 come into contact with each other. By this pressing force, the surface of the pressing roller 21 and the surface of the fixing film 22 come into contact with each other, and a predetermined width of the nip unit NF is formed between the surface of the pressing roller 21 and the surface of the fixing film 22. The total pressing force is 20 kgf. A recording material S is held between the pressure roller 21 and the fixing film 22.

The drive control unit (not illustrated) can control the driving speed of the pressing roller 21, and, as illustrated in FIG. 2, rotates the pressing roller 21 at a predetermined processing speed in the arrow R2 direction in accordance with the print instruction. At this time, a rotation force acts on the fixing film 22 by the frictional force between the surface of the pressing roller 21 and the surface of the fixing film 22 at the nip unit NF. Because of this rotation force, the fixing film 22 rotates around the outer periphery of the heater holder 24 in the arrow R3 direction in the state where the inner peripheral surface of the fixing film 22 comes into contact with and slides on the heater 23. Here the rotation of the fixing film 22 is guided by the outer peripheral surface of the heater holder 24 that is formed to follow the inner peripheral shape of the fixing film 22. Thereby the rotation of the fixing film 22 is stabilized, and the fixing film 22 rotates following the same rotational trajectory. The controller 31 energizes the resistance heating element (not illustrated) of the heater 23 via an energization controller (not illustrated). By this energization, the heater 23 heats up and heats the fixing film 22.

The temperature of the heater 23 is detected by a temperature detecting element 26 (e.g. thermistor) disposed on the rear surface side of the substrate 231 of the heater 23. Based on the output signal from the temperature detecting element 26, the controller 31 controls the energization of the resistance heating element (not illustrated) via the energization controller (not illustrated) so that the heater 23 maintains a predetermined target temperature. In other words, the controller 31 controls power to be supplied to the heater 23, so that the temperature of the heater 23 maintains the target temperature. For example, the controller 31 controls the temperature of the heater 23 by controlling the current to be supplied to the heater 23 in accordance with the signal from the temperature detecting element 26. Thereby the nip unit NF is maintained at a predetermined target temperature. The controller 31 may detect the temperature of the heater 23 as the temperature of the fixing apparatus F. The controller 31 may control the power to be supplied to the fixing apparatus F, so that the temperature of the fixing apparatus F maintains the target temperature. For example, the controller 31 may control the temperature of the fixing apparatus F by controlling the current to be supplied to the fixing apparatus F in accordance with the signal from the temperature detecting element 26. A part of the processing performed by the controller 31 may be performed by a host computer or a server on a network. The host computer or the server on the network are examples of a processor.

1-3 Image Processing Unit

Figure 4:
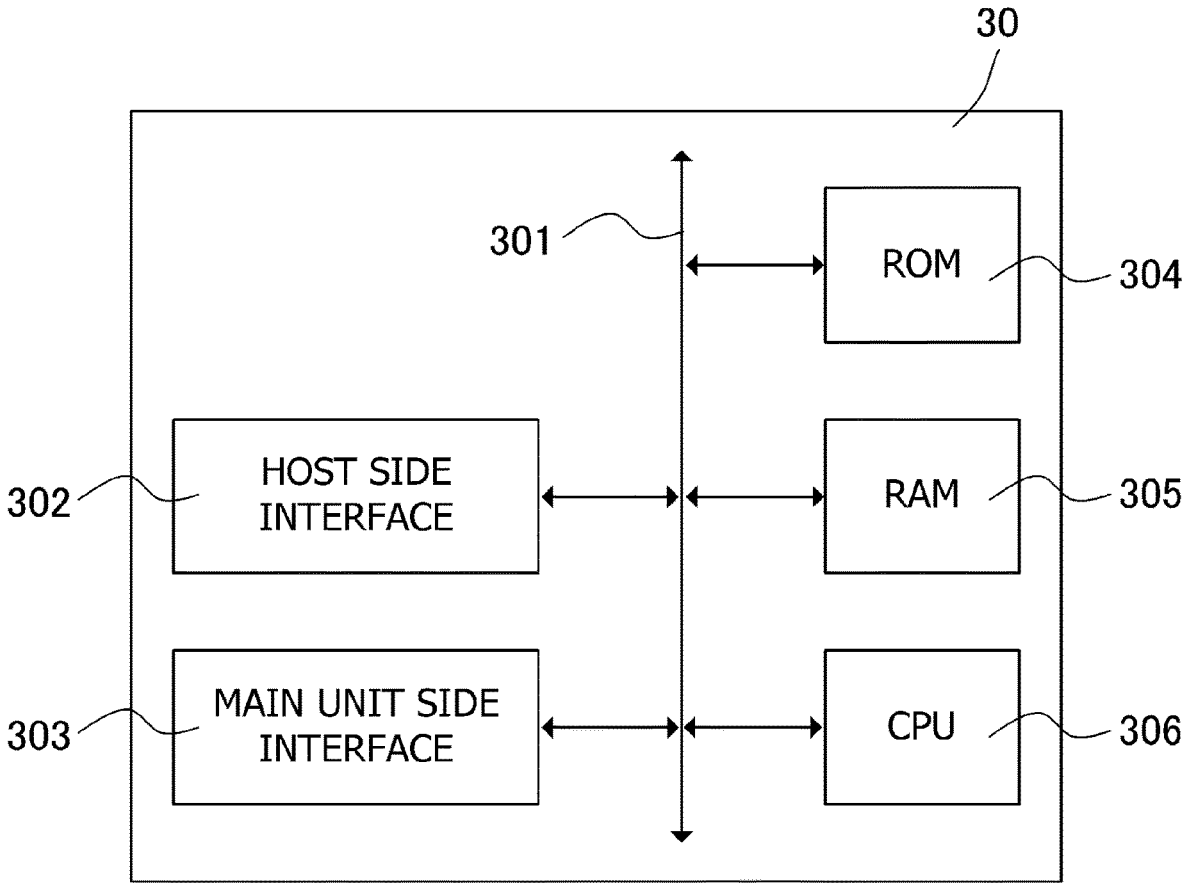
FIG. 4 is a block diagram depicting a video controller according to Embodiment 1.

The video controller 30, as an image processing unit, will be described with reference to FIG. 4. FIG. 4 is a block diagram of the video controller 30. The video controller 30 includes such devices as a host side interface 302, a main unit side interface 303, a ROM 304, a RAM 305 and a CPU 306, which are interconnected via a CPU bus 301. The CPU bus 301 includes address, data and control busses.

The host side interface 302 has a function to bidirectionally connect and communicate with a data transmitting apparatus (e.g. host computer) via a network. The main unit side interface 303 has a function to bidirectionally connect and communicate with the image forming apparatus P. The ROM 304 holds control program codes to execute the later mentioned image data processing and other processing. The RAM 305 is a memory to hold bit map data and image information, which are a result of rendering the image data received by the main unit side interface 303, and to temporarily hold a buffer area and various processing statuses. The CPU 306 controls each device connected to the CPU bus 301 based on the control program codes held in the ROM 304. A part of the processing performed by the video controller 30 may be performed by the host computer or a server on the network.

1-4 Image Data Processing and Detection of Image Gradation Value Information

Figure 5:
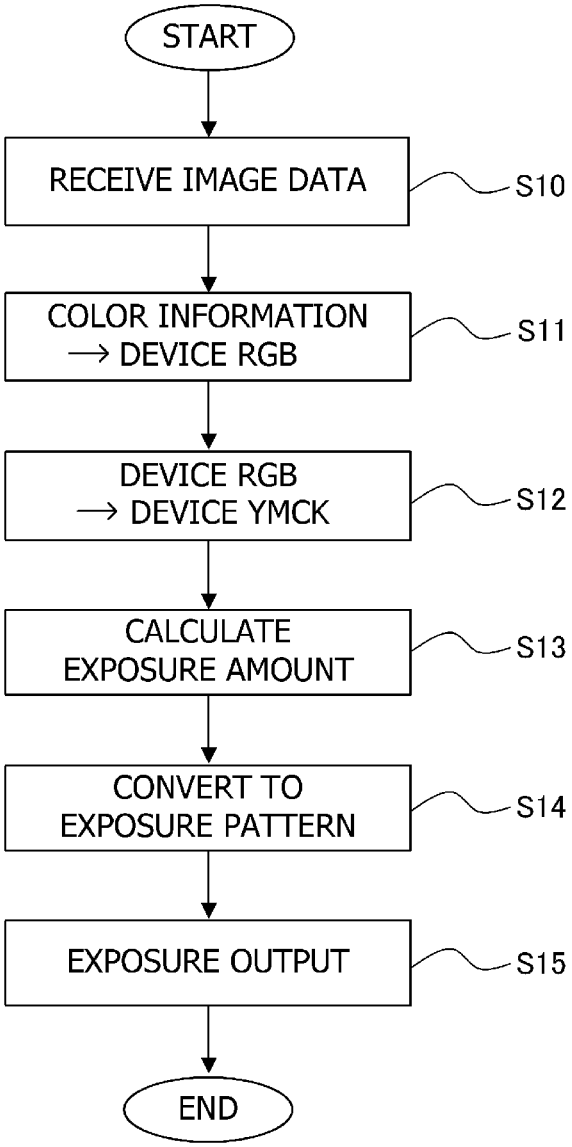
FIG. 5 is a flow chart depicting the processing of image data according to Embodiment 1.

Image data processing will be described. FIG. 5 is a flow chart of the image data processing. First, as image information, image data and commands (e.g. paper size, operation mode) are sent from the host computer to the video controller 30 (S10). If the image data is a color image, the image data has a color information format based on RGB (red, green, blue) data (color data), and each color information is converted into device RGB data, which can be reproduced by the image forming apparatus P (S11). Then for the color information on the image data, the device RGB data is converted into the device YMCK (yellow, magenta, cyan, black) data (S12).

The device YMCK data indicates a ratio of each color with respect to the toner amount formed on the recording material S in the case where all the laser lights of each color of the image forming station are turned ON, and is a gradation value that is at least 0% and not more than 100%. The gradation value 0% indicates a case where all the laser lights are turned OFF, and the toner amount is zero. Here for the YMCK data, the exposure amount of each YMCK color is calculated using a gradation table, which indicates a relationship between the exposure amount of each color and the actually used toner amount (S13). The toner amount is calculated from the gradation values of YMCK. For example, in the case where the gradation values of a predetermined pixel are: Y=50%, M=70%, C=20% and K=0%, the toner amount is 140% (=50+70+20+0). Then for each pixel, the exposure amount of each color is converted into the actually used exposure pattern of each color (S14), and this becomes the exposure output to the photosensitive drum 4 (S15).

1-5 Gradation Value of Image and Toner Amount on Recording Material S

The relationship between the gradation value of an image and toner amount on the recording material S will be described. The gradation value of an image is correlated with the actual toner amount per unit area (toner bearing amount) on the recording material S, and when the gradation value is 100%, the toner bearing amount on the recording material S is 0.45 to 0.50 mg/cm$^2$. When the gradation value is 200%, the toner bearing amount on the recording material S is 0.90 to 1.00 mg/cm$^2$. There are two major reasons why the toner bearing amount on the recording material S has a margin. The first reason is that in the primary transfer, not all the toner on the photosensitive drum 4 can be transferred from the photosensitive drum 4 to the intermediate transfer belt 9. And the second reason is that in the secondary transfer, not all the toner on the intermediate transfer belt 9 can be transferred from the intermediate transfer belt 9 to the recording material S.

1-6 Relationship of Toner of Each Color on Recording Material S and Separation Performance The relationship of the toner of each color on the recording material S and the separation performance of the fixing apparatus F will be described next. As mentioned above, the toner of each color influences the fixing-separation differently depending on the difference of the component of the color (e.g. colorant) used for the toner of each color. Therefore the relationship between the toner of each color on the recording material S and the separation performance of the fixing apparatus F was confirmed.

Experiment 1

Using the image forming apparatus P and the fixing apparatus F according to Embodiment 1, the separation performance of the toner layer (image) formed by the toner of each color on the recording material S was confirmed. The processing speed (conveying speed of recording material S) of the image forming apparatus P in the normal print mode is 150 mm/sec. For the recording material S, LBP print paper (basis weight: 60 g/m$^2$; A4 size (210 mm (W)×297 mm (L); short grain paper) was used. Short grain paper is paper of which machine direction is parallel with the shorter side of the paper. Fibers of the paper expand or contract depending on the humidity, hence paper may expand or constrict in the direction orthogonal to the machine direction. Short grain paper tends to warp in the direction of wrapping around the fixing member, depending on the difference in degree of expansion/contraction between the front and rear surfaces of the paper, which is a disadvantage in terms of separation. Since the purpose of this experiment is to compare the separation performance, the short grain recording material, which has a disadvantage in terms of fixing-separation, was used to make the difference of the separation performance more clear.

For the image pattern, a solid image, where toner is laid on the entire page, was used. The attachment force of the toner on the recording material S increases as the melting at high temperature increases, that is, fixing-separation becomes more difficult. The recording material S was printed one-by-one while changing the target temperature, the target temperature when the fixing-separation failure is generated (failure generation temperature) was recorded, and the failure generation temperature of four colors (yellow, magenta, cyan, black) was compared. Table 1 indicates the failure generation temperature of the toner of each color according to Embodiment 1.

TABLE 1

| Y | M | C | K |
|---|---|---|---|
| 237° C. | 232° C. | 224° C. | 216° C. |

Figure 6:
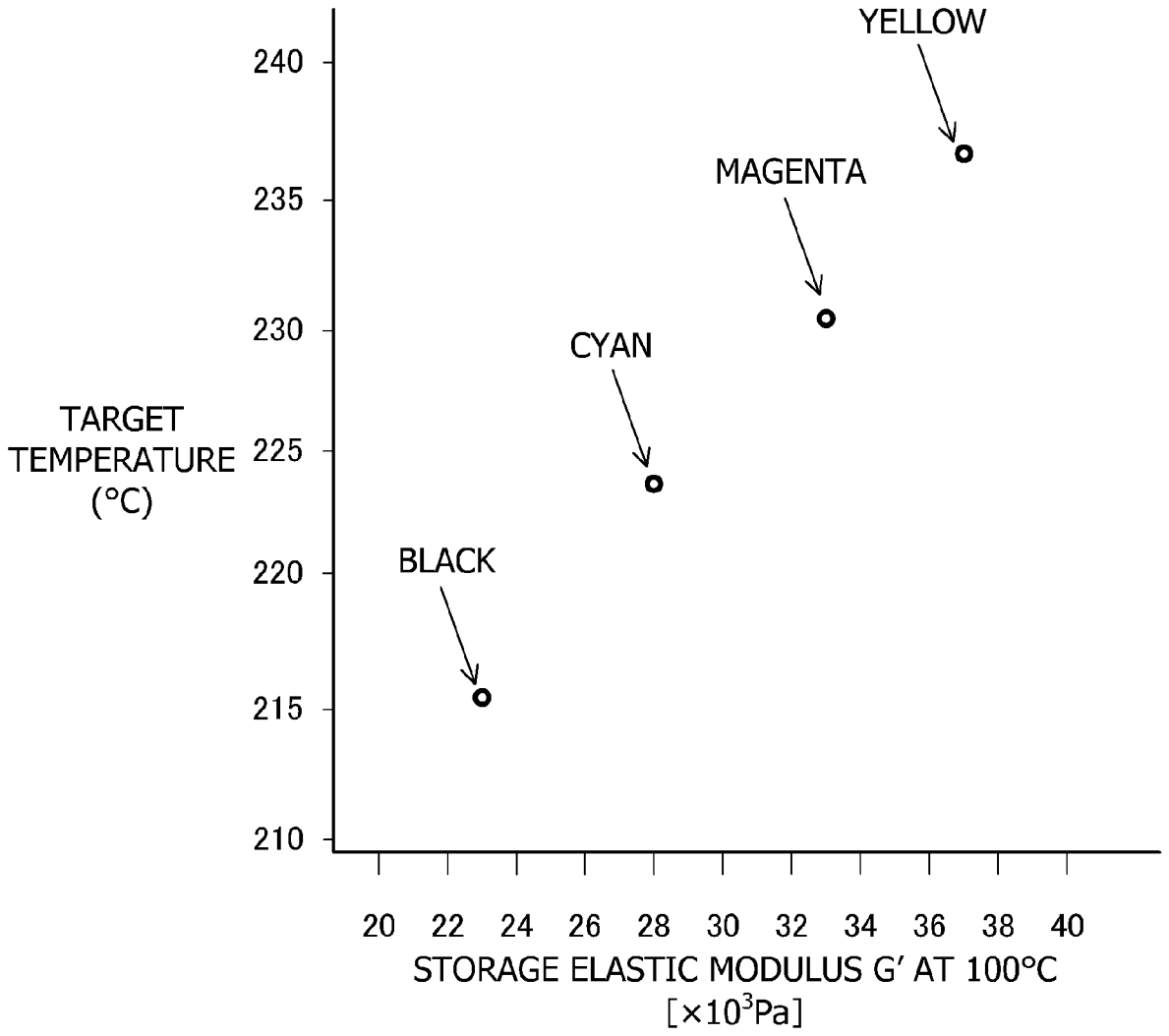
FIG. 6 is a graph depicting a relationship between a storage elastic modulus G' and a failure generation temperature according to Embodiment 1.

The separation performance is highest in yellow (Y), followed by magenta (M), cyan (C) and black (K). FIG. 6 indicates the relationship between the value of the storage elastic modulus G' of the toner of each color measured at 100° C. and the failure generation temperature of the toner of each color. The abscissa in FIG. 6 indicates the storage elastic modulus G' at 100° C., and the ordinate in FIG. 6 indicates the target temperature when the fixing-separation failure occurred (failure generation temperature). The storage elastic modulus G' of the toner of yellow, magenta, cyan and black at 100° C. is different from each other. As indicated in FIG. 6, the separation performance and the storage elastic modulus G' of the toner layer (image) of each color are higher in the sequence of black, cyan, magenta and yellow. In this way, the separation performance of the toner layer (image) of each color and the viscoelasticity (storage elastic modulus G' at 100° C. have a high correlation. If the toner maintains high elasticity even in the melted state at high temperature, the toner more easily separates from the fixing film 22, which indicates a better separation performance.

The storage elastic modulus G' is largely based on JIS K 7244-1, and is defined as follows. The storage elastic modulus G', which is in proportion to the maximum energy stored in a loading cycle, indicates the rigidity of viscoelastic material, and is a real number portion of the complex elastic modulus (unit: Pa). Here the term "complex elastic modulus" indicates a ratio between the dynamic stress and the dynamic strain in the case where sinusoidal vibration is applied to the viscoelastic material. The storage elastic modulus G' of toner was determined using a rotating plate rheometer ARES (manufactured by TA Instruments, Co.). For the measurement samples, a sample formed by pressure-molding a toner at the temperature of 25° C. onto a disk (diameter: 7.9 mm, thickness 2.0±0.3 mm) using a tablet former, was used. Samples were set on parallel plates (diameter: 7.9 mm) and heated at 2.0° C./min temperature rising speed in a 50° C. to 160° C. range under the condition of a 1.0 Hz frequency, with a 1 time/° C. sampling frequency.

1-7 Digitizing Separation Performance (Calculating Separation Index)

Using the above mentioned influence of the color configuration of the toner layer (image) on the separation performance and the characteristic value of the toner, the separation performance of the entire image is digitized. In concrete terms, the separation index is calculated using the gradation value of the toner of each color in an arbitrary pixel; and the storage elastic modulus G' at 100° C. of the toner of each color, which was confirmed that the correlation with the failure generation temperature is high in Experiment 1 (characteristic value of the toner). In the actual calculation of the separation index, the reciprocal of the storage elastic modulus G' is used. As the value of the reciprocal of the storage elastic modulus G' is lower, the characteristic value has a higher advantage in fixing-separation. The following is the calculation formula of the. For example, using this formula, the video controller 30 calculates the separation index S1 based on the following values.

$$S1=\Sigma(Pi\times Di)\ (i=Y,M,C,K) \qquad \text{Separation index}$$

Pi ∝ (proportionality) 1/G'

Pi (i=Y, M, C, K): characteristic value of toner of each color

Di (i=Y, M, C, K): gradation value of toner of each color

Figure 7A:
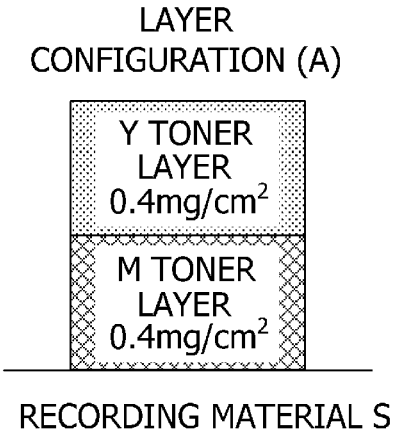
FIG. 7A is a diagram depicting a toner layer configuration of an image according to Embodiment 1.
Figure 7B:
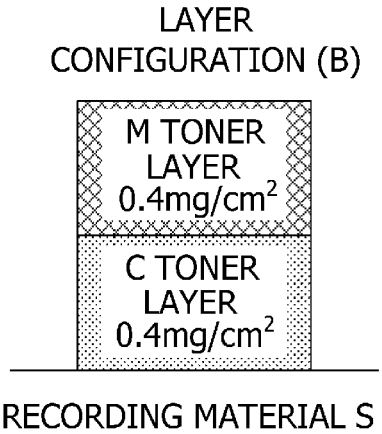
FIG. 7B is a diagram depicting a toner layer configuration of an image according to Embodiment 1.

For example, FIG. 8A and FIG. 8B indicate the separation indexes S1 of the toner layer configurations of FIG. 7A and FIG. 7B. In the case of the toner layer configuration (A) of FIG. 7A, the gradation value of the toner is 160%, which is the total of the Y toner gradation value 80% and the M toner gradation value 80%. In the case of the toner layer configuration (B) of FIG. 7B, the gradation value of the toner is 160%, which is the total of the M toner gradation value 80% and the C gradation value 80%. If the separation index S1 is calculated from these gradation values on the toner and the characteristic values on the toner, the separation index S1 of the toner layer configuration (A) is 4.56, and the separation index S1 of the toner layer configuration (B) is 5.28. The separation index S1 of the toner layer configuration (A), where Y toner, which is advantageous for fixing-separation and has a low characteristic value, is laid on the recording material S, is lower (has better separation performance) than the separation index S1 of the toner layer configuration (B), where C toner, which has a large characteristic value, is laid on the recording material S. By using the separation index S1 as a threshold to determine the print operation mode, an appropriate print mode, in which paper dos not wrap around the fixing member, can be selected.

Instead of the separation index S1, the gradation value of the toner of each color may be used as the threshold to determine the print operation mode. The characteristic value of the toner of each color differs depending on the type of the toner of each color. Unless the type of the toner of each color is changed, the characteristic value of the toner of each color does not change. Therefore if the type of the toner of each color to be used is determined, the print operation mode can be determined using the gradation value of the toner of each color in accordance with the characteristic value of the toner of each color. In the case of using the gradation value of the toner of each color, the print operation mode may be determined depending on whether Dy+Dm+Dc+Dk>110% and Dm+Dc+Dk>50% (hereafter "condition L1") are satisfied. If the gradation value of the toner of each color in a predetermine toner layer configuration satisfies the condition L1, the separation index S1 in the predetermined toner layer configuration is at least 4.9, hence the fixing failure of the fixing apparatus F is suppressed. It is preferable that the condition of the separation index S1 is equivalent to the condition of the gradation value of the toner of each color, but as long as the condition of the separation index S1 (e.g. separation index S≥4.9 in the predetermined toner layer configuration) is satisfied, the condition of the gradation value of the toner of each color may be changed as necessary.

1-8 Relationship Between Toner Distribution on Recording Material S and Separation Performance The relationship between the toner distribution on the recording material S and the separation performance of the fixing apparatus F will be described next. The fixing-separation failure more easily occurs as the toner bearing amount in the front end portion of the recording material S is higher. If no toner exists in the front end portion of the recording material S, the recording material S can be separated relatively easily due to the resilience of the paper, even if the toner bearing amount is high on the rest of the recording material S. On the other hand, if the toner exists in the front end portion of the recording material S, the recording material S more easily wraps around the fixing film 22 since the resilience of the paper cannot be used. In the case where the front end of the recording material S reaches the paper delivery roller 27, which is located at the downstream side in the conveying direction, the separation failure is not generated, since the recording material S is pulled by the paper delivery roller 27, even if the recording material S started to wrap around the fixing film 22. In other words, toner distribution on the recording material S, which tends to cause a fixing-separation failure, is the case where toner exists from the front end of the recording material S to the region where the front end of the recording material S passes the fixing nip NF before reaching the paper delivery roller 27 (passing region of the recording material).

In order to detect a case where toner is distributed from the front end of the recording material S to the passing region of the recording material S, the video controller 30 divides the image data into a plurality of regions, and acquires gradation value information (information on the gradation value) on a plurality of colors for at least one region of the plurality of regions. The gradation value information may be a ratio (%) in the 0 to 100% range, or a density value in the 0 to 255 range, for example. In Embodiment 1, the image data is divided into two regions in the conveying direction, that is: the image information acquiring region Zt (hereafter image region Zt) at the front end side of the recording material S; and the image information acquiring region Zb (hereafter image region Zb) at the rear end side of the recording material S. In Embodiment 1, the paper delivery roller 27 is disposed at a position 50 mm downstream from the fixing nip unit NF in the conveying direction. Therefore the region of the recording material S from the front end to the position 50 mm in the conveying direction is the toner distribution which tends to cause a fixing-separation failure, hence the region of the recording material S from the front end to the position 50 mm in the conveying direction is set as the image region Zt, and the region from the rear end of the image region Zt to the rear end of the recording material S in the conveying direction is set as the image region Zb.

1-9 Operation Mode Determination Flow of Embodiment 1

Figure 9:
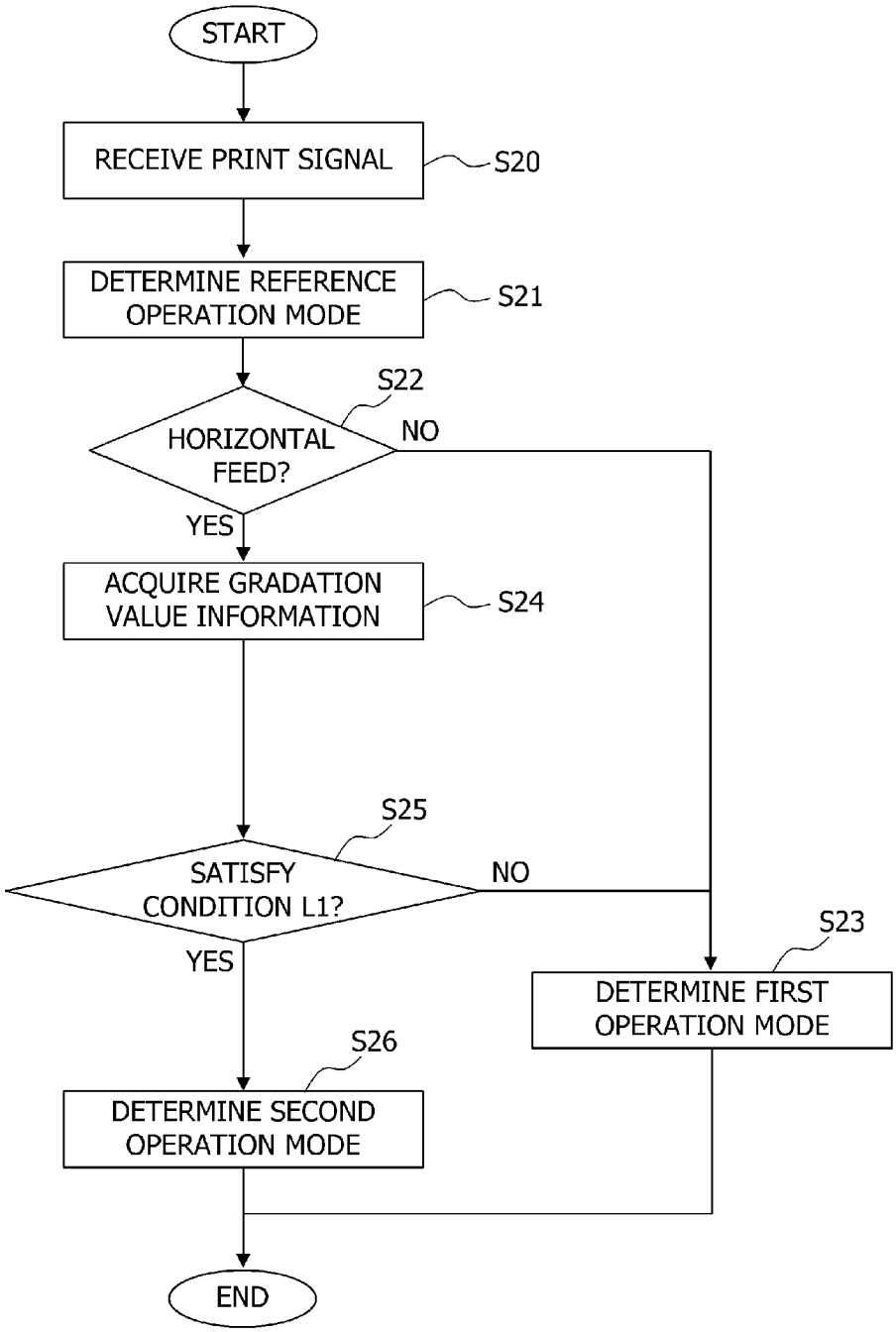
FIG. 9 is a flow chart depicting determination of an operation mode according to Embodiment 1.
Figure 10A:
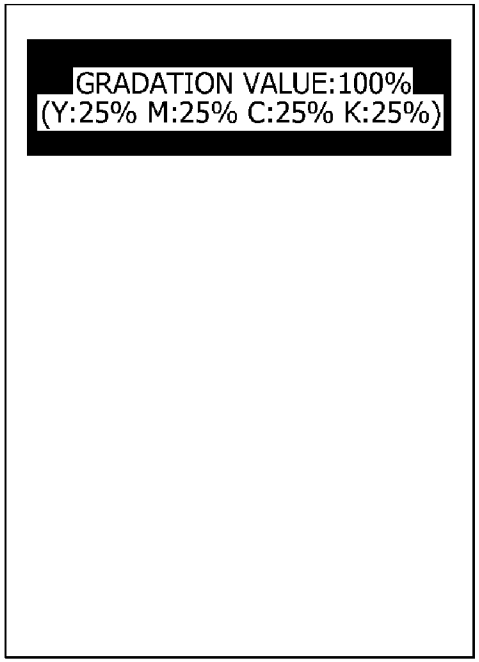
FIGS. 10A to 10E indicate five types of images according to Embodiment 1.
Figure 10B:
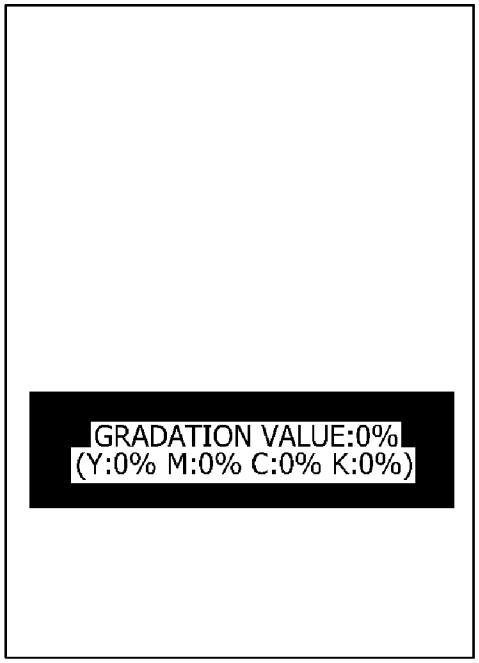
Figure 10C:
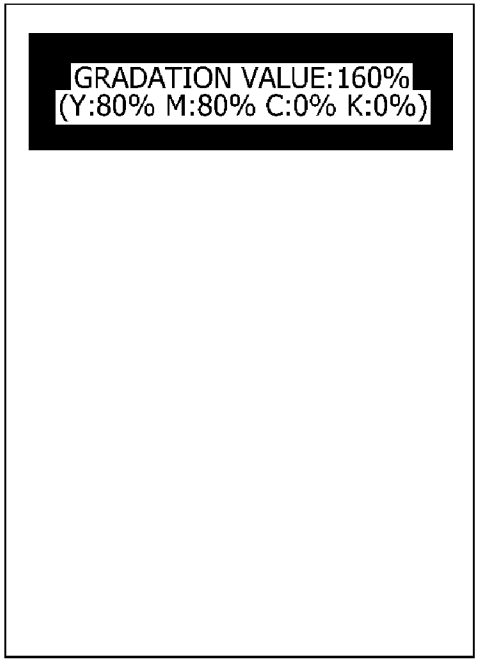
Figure 10D:
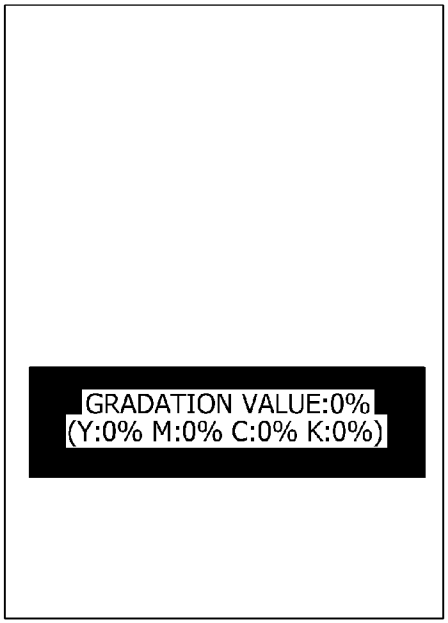
Figure 10E:
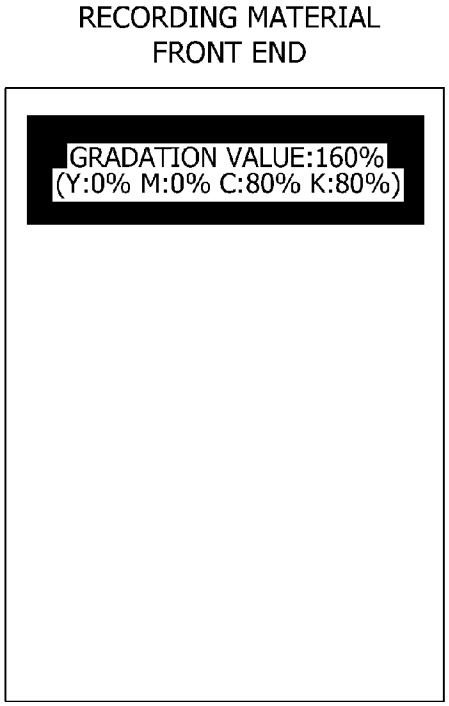

In the image forming apparatus P and the fixing apparatus F according to Embodiment 1, the video controller 30 acquires gradation value information on a plurality of colors in the image region Zt, and the video controller 30 changes the target temperature and the processing speed (conveying speed of recording material S) of the image forming apparatus P. The print operation mode determination flow will be described with reference to the flow chart in FIG. 9.

When the image forming apparatus P receives a print signal from the host computer (S20), the video controller 30 receives commands (e.g. on paper size, operation mode), and determines a reference operation mode based on the temperature information before printing, previous print history and the like (S21). Here a processing example in the case where the paper size is A4 will be described. The reference operation mode is a fixing operation mode that is optimum to fix an image having a standard toner amount, and based on this reference operation mode, the processing speed and the target temperature are determined using the gradation value information on the image. In the reference operation mode of Embodiment 1, the reference speed is 150 mm/sec, and the reference temperature is 200° C.

Then the video controller 30 determines whether the feeding direction of the recording material S is the horizontal feed (S22). If the feeding direction of the recording material S is the vertical feed, that is, if the feeding direction of the recording material S is not a horizontal feed (S22: NO), the video controller 30 determines that the print operation mode is the first operation mode (reference operation mode) (S23). In concrete terms, the video controller 30 determines the processing speed and the target temperature by setting the processing speed to full speed (maximum speed) or to the reference speed, and the target temperature to the reference temperature. Then the print operation mode determination processing ends. On the other hand, if the feeding direction of the recording material S is the horizontal feed (S22: YES), the video controller 30 acquires the gradation value information on the toner layer of each color in the image region Zt divided above, based on the information received from the host computer (S24).

Then the video controller 30 determines whether the gradation value information on the toner layer of each color satisfies an arbitrary condition L1 (Dy+Dm+Dc+Dk>110% and Dm+Dc+Dk>50% in Embodiment 1) (S25). If the gradation information on the toner layer of each color does not satisfy the condition L1 (S25: NO), the video controller 30 determines that the print operation mode is the first operation mode (S23). Then the print operation mode determination processing ends. On the other hand, if the gradation value information on the toner layer of each color satisfies the condition L1 (S25: YES), the video controller 30 determines that the print operation mode is the second operation mode (low temperature, low speed mode) (S26). In concrete terms, the video controller 30 determines the processing speed and the target temperature by setting the processing speed to a speed that is slower than full speed or the reference speed (e.g. 50 mm/sec), and the target temperature to a temperature that is lower than the reference temperature by 20° C. Then the print operation mode determination processing ends. In this way, the video controller 30 compares the gradation value information on the toner layer of each color with the arbitrary condition L1, and determines the print operation mode based on the result of the comparison.

After the print operation mode determination processing ends, the controller 31 controls the fixing of the toner image to the recording material S by the fixing apparatus F, based on the processing speed (conveying speed of recording material S) which was set in S23 or S26. The controller 31 also controls the power to be supplied to the fixing apparatus F or the heater 23, based on the target temperature which was set in S23 or S26, so that the temperature of the fixing apparatus F or the temperature of the heater 23 maintains the target temperature. In the flow chart in FIG. 9, the print operation mode is determined depending on whether the gradation value information on the toner layer of each color satisfies the arbitrary condition L1, but Embodiment 1 is not limited to this processing. The video controller 30 may calculate the separation index S1 based on the characteristic value of the toner of each color and the gradation value information on the toner layer of each color, and determine the print operation mode based on the result of comparing the separation index S1 and the predetermined threshold.

An example of each processing by the fixing apparatus F, the video controller 30 and the controller 31 according to Embodiment 1 will be described below. The fixing apparatus F fixes a toner image, which is formed in accordance with the image data and includes the toner layer of each color (each color image) formed by the toner of each color, onto the recording material S. The fixing apparatus F fixes a first image, which is formed in accordance with the image data by at least the toner of a first color, and a second image, which is formed by the toner of a second color (different from the first color) and is superimposed on the first image, onto the recording material S. Based on the color data of the image data, the video controller 30 acquires the gradation value information on the toner layer of each color in accordance with the layer configuration of the toner layer of each color (each color image) constituting the toner image. Based on the image data, the video controller 30 acquires at least the gradation value information on the first image (first toner layer) and the gradation value information on the second image (second toner layer). The video controller 30 is an example of the acquiring unit. Based on the gradation value information on the toner layer of each color, the video controller 30 determines the target temperature to fix the toner image to the recording material S and the target speed to convey the recording material S. The target speed is, for example, full speed, reference speed or low speed (speed slower than the reference speed). The target temperature is, for example, the reference temperature or a temperature lower than the reference temperature. The video controller 30 is an example of the determining unit. The controller 31 controls the power to be supplied to the fixing apparatus F or the heater 23, so that the temperature of the fixing apparatus F or the heater 23 maintains the target temperature. The controller 31 controls the conveying speed of the recording material S conveyed by the fixing apparatus F based on the target speed.

An example of the processing by the video controller 30 according to Embodiment 1 will be described.

The video controller 30 calculates information on a first value by adding the gradation value information on a first image (first toner layer) of the first toner image, and the gradation value information on a second image (second toner layer) of the first toner image. Based on the information on the first value, the video controller 30 determines that the target temperature is the first temperature, and the target speed is the first conveying speed. For example, a case where the gradation value information on the toner layer of color C (first image) in the first toner image is 40%, and the gradation value information on the toner layer of color K (second image) in the first toner image is 40% will be described. The video controller 30 calculates the information on the first value (80%) by adding the gradation value information on the toner layer of color C (first image) in the first toner image (40%) and the gradation value information on the toner layer of color K (second image) in the first toner image (40%). Since the information on the first value (80%) does not satisfy the condition L1, the video controller 30 determines that the print operation mode is the first operation mode (reference operation mode).

The video controller 30 calculates the information on a second value by adding the gradation value information on the first image (first toner layer) in the second toner image, which is different from the first toner image, and the gradation value information on the second image (second toner layer) in the second toner image. The information on the second value is larger than the information on the first value. Based on the information on the second value, the video controller 30 determines that the target temperature is the second temperature which is lower than the first temperature, and the target speed is the second conveying speed which is slower than the first conveying speed. For example, a case where the gradation value information on the toner layer of color C (first image) in the second toner image is 80% and the gradation value information on the toner layer of color K (second image) in the second toner image is 80% will be described. The video controller 30 calculates the information on the second value (160%) by adding the gradation value information on the toner layer of color C (first image) in the second toner image (80%) and the gradation value information on the toner layer of color K (second image) in the second toner image (80%). Since the information on the second value (160%) satisfies the condition L1, the video controller 30 determines that the print operation mode is the second operation mode (low temperature, low speed mode).

The target temperature in the first operation mode is the reference temperature, and the target temperature in the second operation mode is a temperature lower than the reference temperature. The conveying speed in the first operation mode is full speed or the reference speed, and the conveying speed in the second operation mode is a speed slower than full speed or reference speed.

1-10 Effect Confirmation

Experiment 2

For Embodiment 1 and comparative examples, the occurrence of conveyance jams (Occurred/Not occurred) and the output time when printing is performed were confirmed. The processing speed of the image forming apparatus P in the normal print mode is full speed (150 mm/sec), and the image forming apparatus P also includes a low speed mode (processing speed is 50 mm/sec) as the separation improvement mode. For the recording material S, LBP print paper (basis weight: 60 g/m$^2$; A4 size (210 mm (W)×297 mm (L); short grain paper) was used. Five types of images, (A) to (E) indicated in FIGS. 10A to 10E were printed. In FIGS. 10A to 10E, for each of these images, the gradation value information on the toner layer of each color in the image region Zt is indicated. Each of these images was printed continuously for ten prints using: the image forming apparatus P of Embodiment 1; the image forming apparatus P of Comparative Example 1, which changes the operation mode based on the total of the gradation values as a threshold; and the image forming apparatus P of Comparative Example 2, which has only the reference operation mode.

Figure 11:
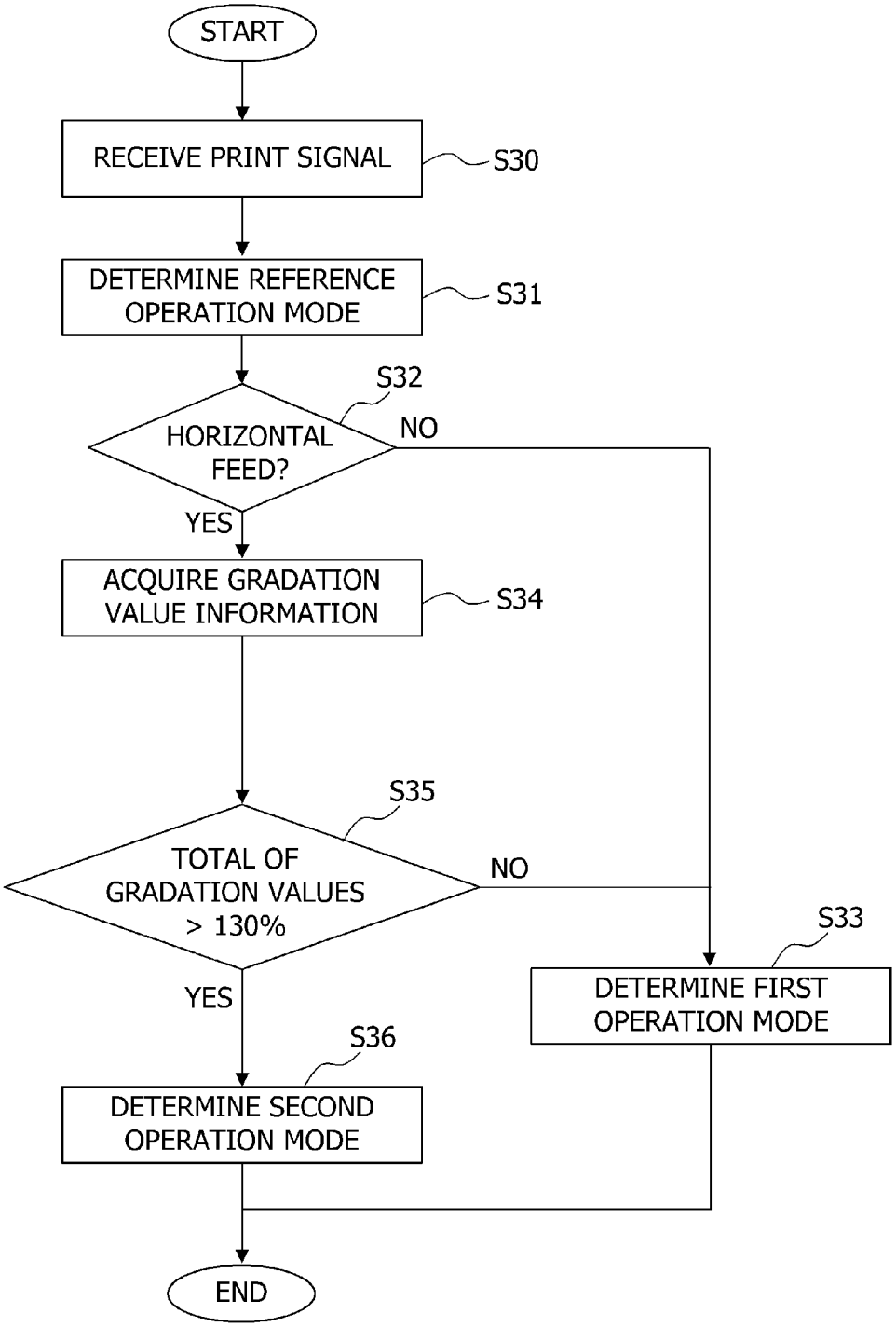
FIG. 11 is a flow chart depicting determination of an operation mode according to Comparative Example 1.

The operation mode determination flow of Comparative Example 1 will be described with reference to the flow chart in FIG. 11. The basic flow of the Comparative Example 1 until the gradation value information on the image is acquired (S30 to S34) is the same as the flow (S20 to S24) of Embodiment 1, hence description thereof is omitted. Then the video controller 30 determines whether the total of the gradation value of the toner layer of each color, acquired in S34, is larger than 130% (S35). If the total of the gradation value of the toner layer of each color is 130% or less (S35: NO), the video controller 30 determines that the print operation mode is the first operation mode (S33). The first operation mode of Comparative Example 1 is the same as that of Embodiment 1. If the total of the gradation value of the toner layer of each color is larger than 130% (S35: YES), on the other hand, the video controller 30 determines that the print operation mode is the second operation mode (S36). The second operation mode of Comparative Example 1 is the same of that of Embodiment 1.

In Comparative Example 2, the processing speed is set to full speed, and the target temperature is set to the reference temperature, regardless the gradation value information on the toner layer of each color acquired in S34.

Table 2 indicates the result of confirming the occurrence of conveyance jams (Occurred/Not occurred) and the output time when printing is performed continuously for 10 prints, for the images (A) to (E) in FIGS. 10A to 10E.

TABLE 2

| | Image (a) | Image (b) | Image (c) | Image (d) | Image (e) |
|---|---|---|---|---|---|
| Embodiment 1 | Not occurred/ 35 seconds | Not occurred/ 35 seconds | Not occurred/ 35 seconds | Not occurred/ 35 seconds | Not occurred/ 112 seconds |
| Comparative Example 1 | Not occurred/ 35 seconds | Not occurred/ 35 seconds | Not occurred/ 112 seconds | Not occurred/ 35 seconds | Not occurred/ 112 seconds |
| Comparative Example 2 | Not occurred/ 35 seconds | Not occurred/ 35 seconds | Occurred/— | Not occurred/ 35 seconds | Occurred/— |

In Comparative Example 2, the operation mode is not changed in accordance with the image information. In the case of the images (A), (B) and (D), of which the total of the gradation values in the image region Zt is 100% or less, the recording materials S on which unfixed toner is fixed were delivered without conveyance jams, and it took 35 seconds to print 10 prints. Further, in Comparative Example 2, in the case of the images (C) and (E), of which the total of the gradation values in the image region Zt is 140%, the recording material S wrapped around the fixing film 22 and a target jam was generated when the first print was printed.

In Comparative Example 1, the operation mode is changed if the total of the gradation value of the toner layer of each color exceeds the threshold (130%). In Comparative Example 1, the recording materials S, on which unfixed toner is fixed, were delivered without conveyance jams for all the images. However in Comparative Example 1, in the case of the images (C) and (E), the operation mode shifted to the separation improvement mode (processing speed: 50 mm/sec), and it took 112 seconds to print 10 prints.

In Embodiment 1, the gradation value condition to enable separation is set for the toner layer of each color, considering the difference in the toner characteristic value of each color, and the video controller 30 determines the operation mode based on the result of comparing the gradation value condition with the gradation value information on the toner layer of each color. In Embodiment 1, in the case of images (A), (B), (C) and (D) in FIGS. 10A to 10D, the recording materials S, on which unfixed toner is fixed, were delivered without conveyance jams, and it took 35 seconds to print 10 prints. Further, in Embodiment 1, in the case of the image (E) in FIG. 10E as well, the operation mode shifted to the fixing-separation improvement mode (processing speed: 50 mm/sec) and the recording materials S were delivered without conveyance jams, although it took 112 seconds to print 10 prints.

In this way, according to Embodiment 1, gradation value information is acquired for each of the plurality of colors in the page respectively, and the processing speed (conveying speed of recording material S) and the target temperature of the image forming apparatus P are controlled in accordance with the layer configuration of the toner image. According to Embodiment 1, optimum fixing control can be selected in accordance with the image, and productivity can be improved while suppressing the occurrence of conveyance jams of the recording material S.

Embodiment 2

The basic configuration of an image forming apparatus P of Embodiment 2 is the same as that of the image forming apparatus P of Embodiment 1, hence an element having the same or equivalent function and configuration as the element of the image forming apparatus P of Embodiment 1 is denoted with the same reference sign, and detailed description thereof will be omitted.

In Embodiment 1, the separation index S1 is calculated using the gradation value of the toner layer of each color at an arbitrary pixel. In Embodiment 2, the print operation mode is determined using the separation index, calculated only for a toner layer of which contribution to the separation performance is large, out of the toner layer configuration, as the determination threshold.

2-1 Relationship Between Toner Bearing Amount on Recording Material S and Separation Performance The relationship between the toner bearing amount on the recording material S and the separation performance of the fixing apparatus F will be described next. As mentioned above, as the toner bearing amount on the recording material S increases, the amount of toner that comes into contact with the fixing film 22 (fixing member) in the melted state increase, hence the attachment force of the toner increases, and it becomes more difficult for the recording material S to separate from the fixing film 22. Therefore the separation performance of the fixing apparatus F was confirmed with changing the toner bearing amount on the recording material S.

Experiment 3

Using the image forming apparatus P and the fixing apparatus F according to Embodiment 2, the separation performance of the fixing apparatus F was confirmed with changing the toner bearing amount on the recording material S. The processing speed (conveying speed of the recording material S) of the image forming apparatus P in the normal print mode is 150 mm/sec. For the recording material S, LBP print paper (basis weight: 60 g/m$^2$; A4 size (210 mm (W)×297 mm (L); short grain paper) was used. Short grain paper is paper of which machine direction is parallel with the shorter side of the paper. Fibers of the paper expand or contract depending on the humidity, hence paper may expand or contract in the direction orthogonal to the machine direction. Short grain paper tends to warp in the direction of wrapping around the fixing member, depending on the difference in degree of expansion/contraction between the front and rear surfaces of the paper, which is a disadvantage in terms of separation. Since the purpose of this experiment is to compare the separation performance, the short grain recording material, which has a disadvantage in terms of fixing-separation, was used to make the difference of the separation performance more clear.

Only K toner was used for printing, and a solid image, where the toner is laid on the entire page surface, was printed. As the melting of the toner on the recording material S progresses at high temperature, the attachment force of the toner increases, and fixing-separation of the recording material S becomes more difficult. The image was printed one print at a time with changing the target temperature, and the target temperature when the fixing-separation failure is generated (failure generation temperature) was recorded. Then the toner bearing amount of the print image was changed from 0.3 mg/cm$^2$ to 0.9 mg/cm$^2$, and the failure generation temperature of each toner bearing amount was compared.

Figure 12:
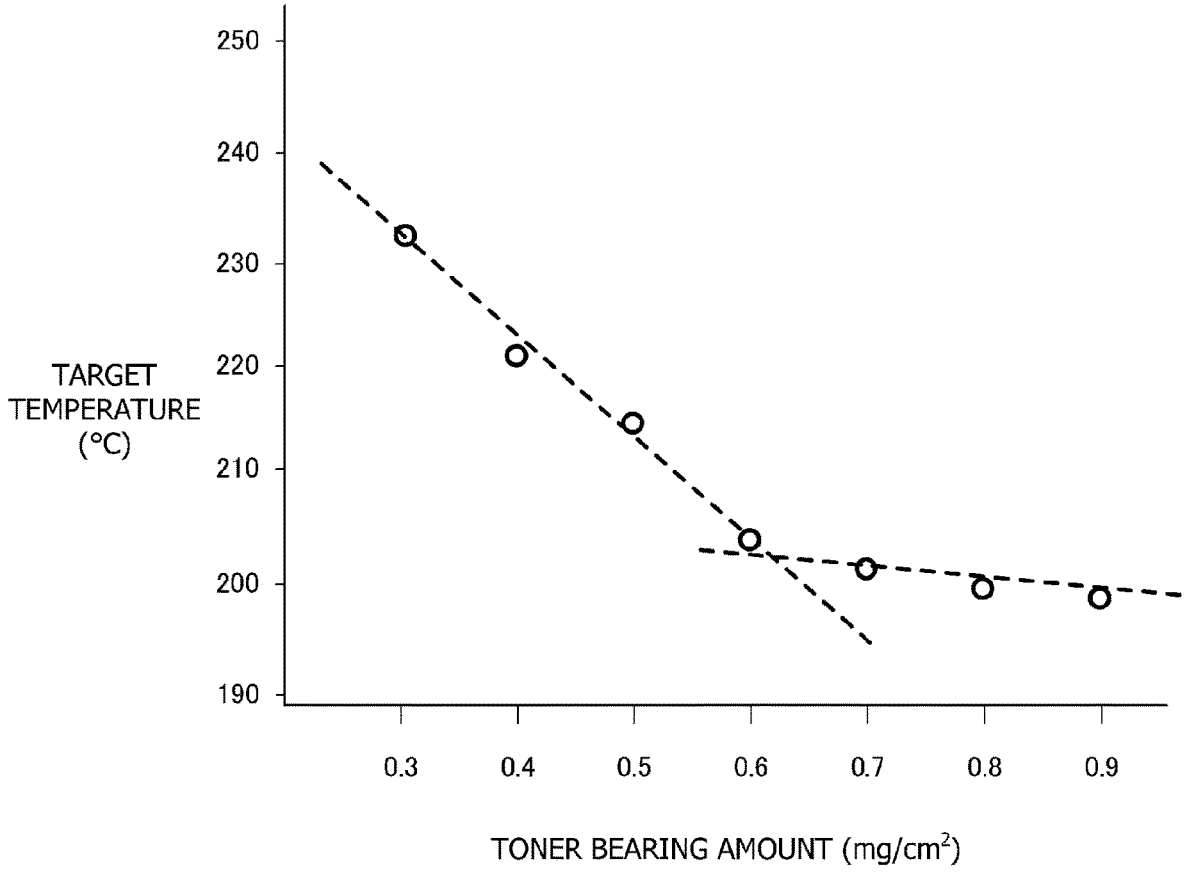
FIG. 12 is a graph depicting a relationship between a toner bearing amount and failure generation temperature according to Embodiment 2.

FIG. 12 indicates the relationship between the toner bearing amount on the recording material S and the failure generation temperature. The abscissa in FIG. 12 indicates the toner bearing amount on the recording material S, and the ordinate in FIG. 12 indicates the target temperature when a fixing-separation failure was generated (failure generation temperature). As the toner bearing amount on the recording material S increases, the target temperature, to enable separation, decreases. In other words, it was confirmed that as the toner bearing amount on the recording material S increases, the separation performance drops.

As indicated in FIG. 12, the relationship between the toner bearing amount on the recording material S and the failure generation temperature changes at a point where the toner bearing amount on the recording material S exceeds 0.6 mg/cm$^2$. In FIG. 12, the slope of the linear approximate line of the plot when the toner bearing amount is 0.6 mg/cm$^2$ or less and the slope of the linear approximate line of the plot when the toner bearing amount exceeds 0.6 mg/cm$^2$ are different. When the toner bearing amount exceeds 0.6 mg/cm$^2$, the change of the failure generation temperature becomes small, and the influence of the toner bearing amount on the separation performance decreases. This is probably because the amount of toner that directly comes into contact with the fixing film 22 at the fixing nip NF saturates when the t toner bearing amount on the recording material S exceeds 0.6 mg/cm$^2$. The average particle diameter of the toner used in Embodiment 2 is about 6 μm, and the toner bearing amount 0.6 mg/cm$^2$ corresponds to the amount of toner for about two layers. This amount of toner for about two layers is the amount of toner that can cover the surface of the recording material S completely, and is the amount of toner that melts (melt toner amount) first when the toner directly comes into contact with the fixing film 22. In other words, the melt toner amount is the amount of toner on the portion of the toner image on the contacting side to the fixing film 22 (first portion), and is the amount of toner on the portion corresponding to a predetermined toner bearing amount (0.6 mg/cm$^2$ in Embodiment 2) per unit area (first portion). In other words, the melt toner amount is the amount of toner in a portion (first portion) which is on the contacting side to the fixing film 22 on the toner image and fully covers the surface of the recording material S. The amount of toner that is required to completely cover the surface of the recording material S differs depending on the average particle diameter of the toner, and as the average particle diameter of the toner is smaller, the amount of toner that is required to completely cover the surface of the recording material S decreases.

Experiment 4

It is known by study that in the case where a toner image is formed by toner layers of a plurality of colors which are superimposed, the fixing-separation is influenced more by a toner layer on the contacting side to the fixing film 22 than by the toner layer on the recording material S side in the toner image on the recording material S. When the unfixed toner on the recording material S is melted by contact heating, the toner existing on the fixing film 22 side is directly in contact with the fixing film 22. Therefore the toner existing on the fixing film 22 side is heated and melted before the toner existing on the recording material S side, and more easily attaches to the fixing film 22. As a consequence, the fixing-separation is influenced more by the toner layer on the contacting side to the fixing film 22 than by the toner on the recording material S side. Therefore even if the toner bearing amount is the same, the margin of the fixing-separation differs depending on the layer configuration of the toner layers of a plurality of colors constituting the toner image.

Figure 13A:
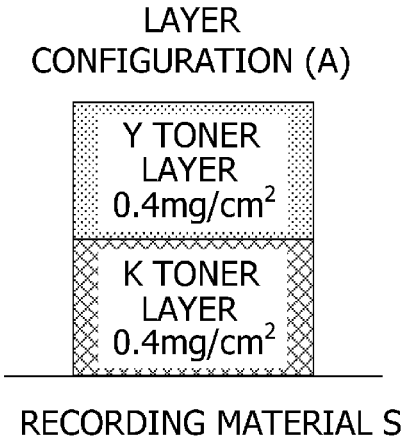
FIG. 13A is a diagram depicting a toner layer configuration of an image according to Embodiment 2.
Figure 13B:
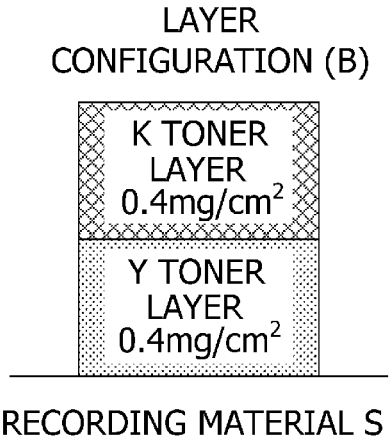
FIG. 13B is a diagram depicting a toner layer configuration of an image according to Embodiment 2.

Using the image forming apparatus P and the fixing apparatus F, the toner bearing amount on the recording material S is fixed to 0.4 g/cm$^2$ for Y toner, and 0.4 g/cm$^2$ for K toner (total toner amount: 0.8 g/cm$^2$), and the failure generation temperature was compared between the normal case and the case of replacing the layer positions of the Y toner and the K toner vertically. In concrete terms, the image forming station 3K is filled with Y toner and 3Y is filled with K toner. Thereby an image having the normal toner layer configuration (A) as illustrated in FIG. 13A, where the Y toner layer exists on the upper toner layer on the directly-contacting side to the fixing film 22, and the K toner layer exists on the lower toner layer on the side of the recording material S, is formed. Further, an image having the layer configuration (B) as illustrated in FIG. 13B, where the K toner layer exists on the upper toner layer on the directly-contacting side to the fixing film 22, and the Y toner layer exists on the lower toner layer on the side of the recording material S, is formed, reversing the positions of the Y toner and the K toner. Then the failure generation temperature of the image having the toner layer configuration (A) and that of the image having the toner layer configuration (B) were compared. The processing speed (conveying speed of recording material S) in the normal print mode of the image forming apparatus P, the recording material S and the images used for Experiment 4 are all the same as Experiment 3. Table 3 indicates the failure generation temperature of each layer configuration according to Embodiment 2.

TABLE 3

| | |
|---|---|
| Image having layer configuration (A) | 220° C. |
| Image having layer configuration (B) | 210° C. |

According to this result, even if the amount of the Y toner and that of the K toner on the recording material S are the same, the failure generation temperature of the image having the toner layer configuration (A) is lower than that of the image having the toner layer configuration (B) by 10° C. It was known by the results in Experiment 1 that the separation performance of the Y toner is higher than the separation performance of the K toner, which means that the separation performance of toner existing on the directly-contacting side to the fixing film 22 influences more on the failure generation temperature. When the unfixed toner image on the recording material S is melted by contact heating, the toner existing on the fixing film 22 side comes into directly contact with the fixing film 22. The toner existing on the fixing film 22 side is heated and melted before the toner existing on the recording material S side, and more easily attaches to the fixing film 22. This is why the separation performance of the toner existing on the fixing film 22 side influences the failure generation temperature.

2-2 Calculating Separation Index

Using the above mentioned influence of the layer configuration of the toner on the separation performance, and the characteristic values of the toner, the separation index, that indicates the separation performance of the image in general, is calculated. For the separation index, a value corresponding to the upper toner layer portion, out of the gradation value of the toner of each color in an arbitrary pixel, is used. The upper toner layer is a portion of the toner image on the contacting side to the fixing film 22 (first portion), of which influence on the separation performance is large, as indicated by the result of Experiment 3, and is the toner layer of each color in a portion from the surface of the toner image to the position corresponding to the toner bearing amount 0.6 mg/cm$^2$ (first portion). In other words, the upper toner layer is a portion of the toner image on the contacting side to the fixing film 22 (first portion), and is a toner layer of each color in the portion completely covering the surface of the recording material S (first portion). In Embodiment 2, the total of the gradation value of the toner layer of each color in the upper toner layer portion (upper layer gradation value of toner of each color) is assumed to be 120% at the maximum. This upper limit of the total of the gradation value of the toner layer of each color in the upper toner layer portion may be set to a value of at least 80% and not more than 160%. For the characteristic value of the toner, a storage elastic modulus G' at 100° C. of the toner of each color, which was confirmed that the correlation with the failure generation temperature is high in Experiment 1, is used. In other words, the characteristic value of the toner is a value determined using the storage elastic modulus G' at 100° C. of the toner of each color. In the actual calculation of the characteristic value, the reciprocal of the storage elastic modulus G' is used. As the value of the reciprocal of the storage elastic modulus G' is lower, the characteristic value has a higher advantage in terms of fixing-separation. Using the following formula, the video controller 30 calculates the separation index S1 based on these values.

$$S1=\Sigma(Pi\times Di)\ (i=Y, M, C, K) \qquad \text{Separation index}$$

Pi ∝ (proportionality) 1/G'

Pi (i=Y, M, C, K): characteristic value of toner of each color

Dti (i=Y, M, C, K): gradation value of upper layer of toner of each color

For example, FIG. 14A and FIG. 14B indicate the separation index S1 of the toner layer configurations used for Experiment 4. In the case of the toner layer configuration (A) of FIG. 14A, the Y toner gradation value of the upper toner layer (value corresponding to the upper toner layer out of the Y toner gradation values) is 80%, and the K toner gradation value of the upper layer of the toner (value corresponding to the upper toner layer out of the K toner gradation values) is 40%. In the case of the toner layer configuration (B) in FIG. 14B, the Y toner gradation value of the upper toner layer is 40%, and the K toner gradation value of the upper toner layer is 80%. If the separation index S1 is calculated from these gradation values and characteristic values of the toner, the separation index S1 of the image of the toner layer configuration (A) is 3.88, and the separation index S1 of the image of the toner layer configuration (B) is 4.52. The separation index S1 of the toner layer configuration (A), where the laid-on level of the Y toner, which is advantageous in terms of fixing-separation, is high in the upper toner layer, is small, that is, the separation index S1 of the toner layer configuration (A) has a better separation performance than the separation index S1 of the toner layer configuration (B).

2-3 Relationship Between Toner Distribution on Recording Material S and Separation Performance The relationship between the toner distribution on the recording material S and the separation performance of the fixing apparatus F will be described next. A fixing-separation failure more easily occurs as the toner bearing amount in the front end portion of the recording material S is higher. If no toner exists in the front end portion of the recording material S, the recording material S can be separated relatively easily due to the resilience of the paper, even if the toner bearing amount is high on the rest of the recording material S. On the other hand, if the toner exists in the front end portion of the recording material S, the recording material S more easily wraps around the fixing film 22 since the resilience of the paper cannot be used. In the case where the front end of the recording material S reaches the paper delivery roller 27, which is located at the downstream side in the conveying direction, the separation failure is not generated since the recording material S is pulled by the paper delivery roller 27, even if the recording material S starts to wrap around the fixing film 22. In other words, toner distribution on the recording material S, which tends to cause a fixing-separation failure, is the case where toner exists from the front end of the recording material S to the region that the front end of the recording material S passes the fixing nip NF before reaching the paper delivery roller 27 (passing region of the recording material S).

In order to detect a case where toner is distributed from the front end of the recording material S to the passing region of the recording material S, the video controller 30 divides the image data into a plurality of regions, and acquires gradation value information on a plurality of colors for at least one region of the plurality of regions. In Embodiment 2, the image data is divided into two regions in the conveying direction, that is: the image information acquiring region Zt (hereafter image region Zt) at the front end side of the recording material S; and the image information acquiring region Zb (hereafter image region Zb) at the rear end side of the recording material S. In Embodiment 2, the paper delivery roller 27 is disposed at a position 50 mm downstream from the fixing nip unit NF in the conveying direction. Therefore the region of the recording material S from the front end to the position 50 mm in the conveying direction is the toner distribution, which tends to cause a fixing-separation failure, hence the region of the recording material S from the front end to the position 50 mm in the conveying direction is set as the image region Zt, and the region from the rear end of the image region Zt to the rear end of the recording material S in the conveying direction is set as the image region Zb.

2-4 Operation Mode Determination Flow of Embodiment 2

Figure 15:
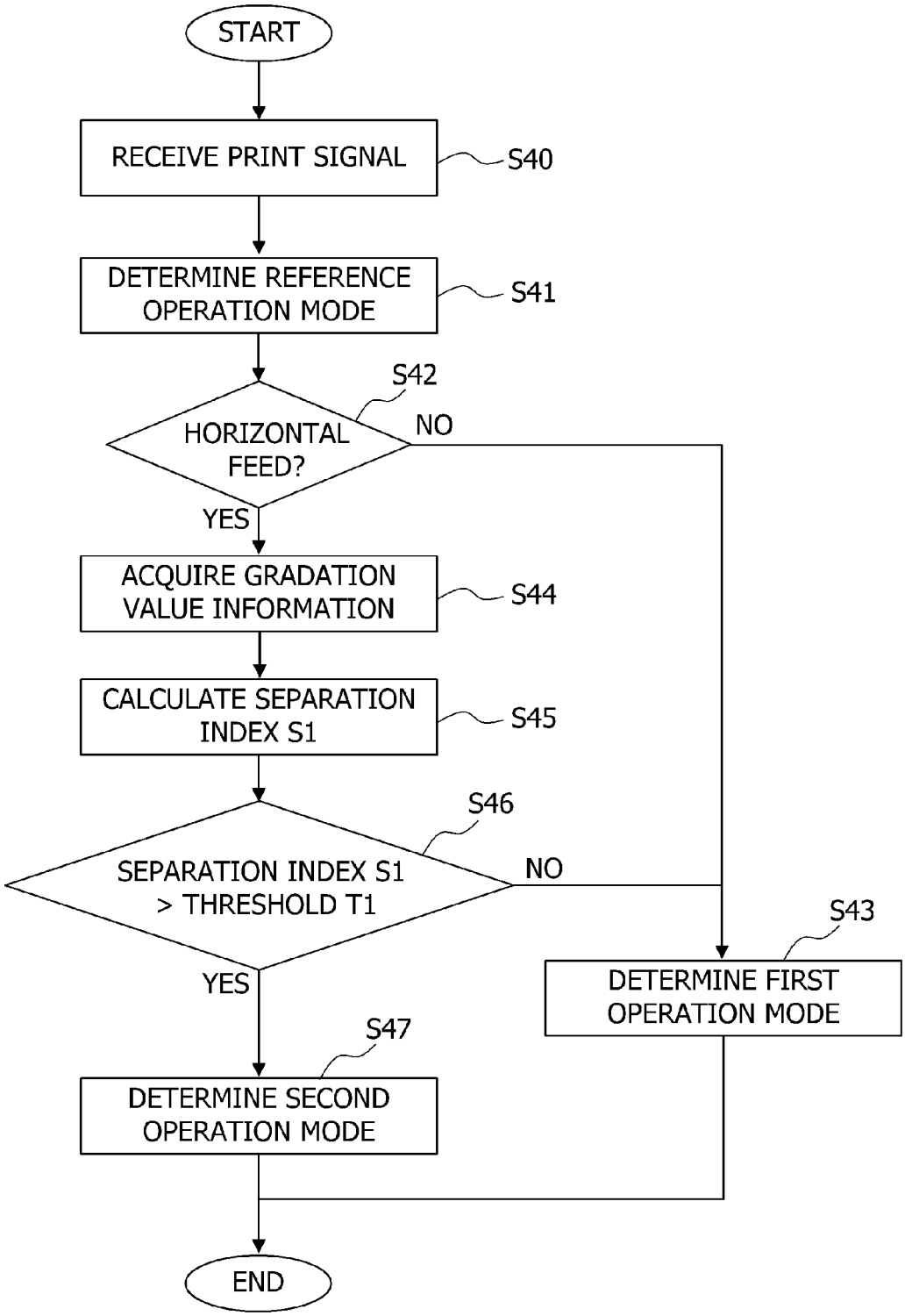
FIG. 15 is a flow chart depicting determination of an operation mode according to Embodiment 2.

In the image forming apparatus P and the fixing apparatus F according to Embodiment 2, the video controller 30 acquires gradation value information on a plurality of colors in the image region Zt, and calculates the separation index S1 using the acquired information and the toner characteristic values. Then the video controller 30 changes the target temperature and the processing speed (conveying speed of recording material S) of the image forming apparatus P. The print operation mode determination flow will be described with reference to the flow chart in FIG. 15.

When the image forming apparatus P receives a print signal from the host computer (S40), the video controller 30 receives commands (e.g. paper size, operation mode) and determines a reference operation mode based on the temperature information before printing, previous print history and the like (S41). Here a processing example in the case where the paper size is A4 will be described. The reference operation mode is a fixing operation mode that is the optimum to fix an image having a standard toner amount, and is based on this reference operation mode, the processing speed and the target temperature are determined using the gradation value information on the image. In the reference operation mode of Embodiment 2, the reference speed is 150 mm/sec, and the reference temperature is 200° C.

Then the video controller 30 determines whether the feeding direction of the recording material S is the horizontal feed (S42). If the feeding direction of the recording material S is the vertical feed, that is, if the feeding direction of the recording material S is not a horizontal feed (S42: NO), the video controller 30 determines that the print operation mode is the first operation mode (reference operation mode) (S43). In concrete terms, the video controller 30 determines the processing speed and the target temperature by setting the processing speed to full speed (maximum speed) or the reference speed, and the target temperature to the reference temperature. Then the print operation mode determination processing ends. On the other hand, if the feeding direction of the recording material S is the horizontal feed (S42: YES), the video controller 30 acquires the gradation value information on the toner layer of each color in the image region Zt divided above, based on the information received from the host computer (S44). The gradation value information on the toner layer of each color includes the gradation value of the toner layer of each color in the upper toner layer portion in the image region Zt. Then the video controller 30 calculates the separation index S1 based on the characteristic value of the toner of each color and the gradation value of the toner layer of each color in the upper toner layer portion (S45).

Then the video controller 30 determines whether the separation index S1 is larger than an arbitrary threshold T1 (4.5 in Embodiment 2) (S46). If the separation index S1 is the threshold T1 or less (S46: NO), the video controller 30 determines that the print operation mode is the first operation mode (S43). Then the print operation mode determination processing ends. On the other hand, if the separation index S1 is larger than the threshold T1 (S46: YES), the video controller 30 determines that the print operation mode is the second operation mode (low temperature, low speed mode) (S47). In concrete terms, the video controller 30 determines the processing speed and the target temperature by setting the processing speed to a speed slower than the reference speed (e.g. 50 mm/sec), and the target temperature to a temperature lower than the reference temperature by 20° C. Then the print operation mode determination processing ends. In this way, the video controller 30 compares the separation index S1 and the threshold T1 (first threshold), and determines the print operation mode based on the result of the comparison.

After the print operation mode determination processing ends, the controller 31 controls the fixing of the toner image to the recording material S by the fixing apparatus F, based on the processing speed (conveying speed of recording material S), which was set in S43 or S47. The controller 31 also controls the power to be supplied to the fixing apparatus F or the heater 23 based on the target temperature which was set in S43 or S47, so that the temperature of the fixing apparatus F or the temperature of the heater 23 maintains the target temperature.

An example of each processing by the video controller 30 and the controller 31 according to Embodiment 2 will be described below. The video controller 30 acquires the gradation value information on the toner layer of each color in accordance with the layer configuration of the toner layer of each color constituting the toner image, based on the color data of the image data. Based on the color data of the image data, the video controller 30 acquires the characteristic value of the toner of each color in the toner layer of each color constituting the toner image. The video controller 30 is an example of the acquiring unit. Based on the gradation value information on the toner layer of each color and the characteristic value of the toner of each color, the video controller 30 determines the target temperature to fix the toner image to the recording material S and the target speed to convey the recording material S. The video controller 30 multiplies the gradation value of the toner layer of each color by the characteristic value of the toner of each color respectively, and compares the total value of the calculated values (separation index S1) with a threshold, then determines the target temperature and the target speed based on the result of this comparison. The target speed is, for example, full speed, reference speed or low speed (speed slower than the reference speed). The target temperature is, for example, the reference temperature or a temperature lower than the reference temperature. The video controller 30 is an example of the determining unit. The controller 31 controls the power to be supplied to the fixing apparatus F or the heater 23, so that the temperature of the fixing apparatus F or the heater 23 maintains the target temperature. The controller 31 controls the conveying speed of the recording material S conveyed by the fixing apparatus F, based on the target speed.

The video controller 30 may determine the target temperature and the target speed based on the total of the values calculated by multiplying the gradation value of the toner layer of each color by the characteristic value of the toner of each color respectively (separation index S1). For example, a table corresponding the separation index, the target temperature and the target speed is stored in memory in advance. The video controller 30 may determine the target temperature and the target speed in accordance with the calculated total (separation index S1) based on the table stored in the memory.

2-5 Confirming Effect

Experiment 5

For Embodiment 2 and the comparative examples, the occurrence of conveyance jams (Occurred/Not occurred) and the output time when printing is performed were confirmed. The processing speed of the image forming apparatus P in the normal print mode is full speed (150 mm/sec), and the image forming apparatus P also includes a low speed mode (processing speed is 50 mm/sec) as the separation improvement mode. For the recording material S, LBP print paper (basis weight: 60 g/m$^2$; A4 size (210 mm (W)×297 mm (L); short grain paper) was used. Five types of images (A) to (E) indicated in FIGS. 10A to 10E were printed. In FIGS. 10A to 10E, for each of these images, the gradation value information on the toner layer of each color in the image region Zt and the separation index S1 are indicated in FIGS. 16A to 16E. Each of these images was printed continuously for ten prints using: the image forming apparatus P of Embodiment 2; the image forming apparatus P of Comparative Example 3 which changes the operation mode based on the total of the gradation values as a threshold; and the image forming apparatus P of Comparative Example 4 which has only the reference operation mode. Comparative Example 3 is the same as Comparative Example 1, and Comparative Example 4 is the same as Comparative Example 2.

Table 4 indicates the result of the occurrence of conveyance jams (Occurred/Not occurred) and the output time when printing is performed continuously for ten prints, for the images (A) to (E) in FIGS. 10A to 10E.

TABLE 4

| | Image (a) | Image (b) | Image (c) | Image (d) | Image (e) |
|---|---|---|---|---|---|
| Embodiment 2 | Not occurred/ 35 seconds | Not occurred/ 35 seconds | Not occurred/ 35 seconds | Not occurred/ 35 seconds | Not occurred/ 112 seconds |
| Comparative Example 3 | Not occurred/ 35 seconds | Not occurred/ 35 seconds | Not occurred/ 112 seconds | Not occurred/ 35 seconds | Not occurred/ 112 seconds |
| Comparative Example 4 | Not occurred/ 35 seconds | Not occurred/ 35 seconds | Occurred/— | Not occurred/ 35 seconds | Occurred/— |

In Comparative Example 4, the operation mode is not changed in accordance with the image information. In Comparative Example 4, in the case of the images (A), (B) and (D) of which total of the gradation values in the image region Zt is 100% or less, the recording materials S, on which unfixed toner is fixed, were delivered without conveyance jams, and it took 35 seconds to print ten prints. Further, in Comparative Example 4, in the case of the images (C) and (E) of which total of the gradation values in the image region Zt is 160%, the recording material S wrapped around the fixing film 22, and conveyance jams were occurred when the first print was printed.

In Comparative Example 3, the operation mode is changed if the total of the gradation value of the toner layer of each color exceeds the threshold (130%). In Comparative Example 3, the recording materials S on which unfixed toner is fixed were delivered without conveyance jams for all the images. However, in Comparative Example 3, in the case of the images (C) and (E) in FIGS. 10C and 10E, the operation mode shifted to the separation improvement mode (processing speed: 50 mm/sec), and it took 112 seconds to print ten prints.

In Embodiment 2, the separation index S1, calculated based on the gradation value of the toner layer of each color in accordance with the layer configuration and the characteristic value of the toner of each color, is compared with the threshold T1, and the operation mode, is determined based on the result of the comparison. In Embodiment 2, in the case of the images (A), (B), (C) and (D) in FIGS. 10A to 10D, the recording materials S on which unfixed toner is fixed were delivered without conveyance jams, and it took 35 seconds to print ten prints. Further, in Embodiment 2, in the case of the image (E) in FIG. 10E as well, the operation mode shifted to the fixing-separation improvement mode (processing speed: 50 mm/sec), and the recording materials S were delivered without conveyance jams, although it took 112 seconds to print ten prints.

FIGS. 16A to 16E indicate the separation indexes S1 of the images (A) to (E) in FIGS. 10A to 10E described above. The separation index that enables fixing-separation when the target temperature is 200° C. is 5.4. In Embodiment 2, the threshold T1 to determine the separation index S1 is 4.5, considering the margin, such as the dispersion of the toner bearing amount on the recording material S and the influence of the lower toner layer. Therefore in Embodiment 2, even in the case of the image (E) in FIG. 10E, the recording material S on which the unfixed toner is fixed was delivered without conveyance jams, although the print output time increased.

In this way, according to Embodiment 2, gradation value information is acquired for each of the plurality of colors in the page respectively, and the processing speed (conveying speed of recording material S) and the target temperature of the image forming apparatus P are controlled in accordance with the layer configuration of the toner image. According to Embodiment 2, optimum fixing control can be selected in accordance with the image, and productivity can be improved while suppressing the occurrence of conveyance jams of the recording material S.

Embodiment 3

3-1 Image Forming Apparatus

The basic configuration of an image forming apparatus P of Embodiment 3 is the same as that of the image forming apparatus P of Embodiment 1, hence an element having the same or equivalent function and configuration of the element of the image forming apparatus P of Embodiment 1 is denoted with the same reference sign, and detailed description thereof will be omitted.

In Embodiment 2, the separation index S1 is calculated using the gradation value of only the upper toner layer portion of each color in an arbitrary pixel. This is because the portion of the toner image on the contacting side to the fixing film 22 (first portion) and the portion corresponding to the toner bearing amount 0.6 mg/cm$^2$ (first portion) has a major influence on the fixing-separation as indicated by the result of Experiment 3 of Embodiment 2. However, in some cases the toner layer on the recording material S side has a minor influence on the fixing-separation. Therefore in Embodiment 3, the influence of the toner layer on the recording material S side (lower toner layer) on the separation performance is corrected first, then the correction value is added to the gradation value of the toner layer of each color, and the separation index, to indicate the separation performance of the image in general, is calculated using the characteristic value of the toner. The relationship between the toner distribution on the recording material S and the separation performance is the same as Embodiment 2.

3-2 Calculating Separation Index

In Embodiment 3, to calculate the separation index, the upper toner layer portion and the lower toner layer portions of the gradation value of the toner layer of each color in an arbitrary pixel are used. Just like Embodiment 2, the upper toner layer is a portion of the toner image on the contacting side to the fixing film 22 (first portion), and is a toner layer of each color included in the portion from the surface of the toner image to the position at the toner bearing amount 0.6 mg/cm$^2$ (first portion). In other words, the upper toner layer portion is a portion of the toner image on the contacting side to the fixing film 22 (first portion), and is a toner layer of each color included in the portion completely covering the surface of the recording material S (first portion). In Embodiment 3, the total of the gradation value of the toner layer of each color in the upper toner layer portion is assumed to be 120% at the maximum. This upper limit of the total of the gradation value of the toner layer of each color of the upper toner layer portion may be set to a value of at least 80% and not more than 160%.

The lower toner layer, on the other hand, is a portion of the toner image on the side of the recording material S, which is the portion other than the upper toner layer in the case where the toner bearing amount of the toner image is at least 0.6 mg/cm$^2$. In other words, the lower toner layer is a second portion of the toner image on the side of the recording material S, and is a toner layer included in the second portion which is the remaining portion other than the first portion from the surface of the toner image to the position at the toner bearing amount 0.6 mg/cm$^2$. In other words, the lower toner layer is a second portion of the toner image on the side of the recording material S, and a toner layer included in the remaining second portion other than the first portion completely covering the surface of the recording materials S. If the total of the gradation value of the toner layer of each color of the upper toner layer portion is 120% or less, the lower toner layer does not exist in the toner image. In other words, if the total of the gradation value of the toner layer of each color of the upper toner layer portion is 120% or less, the gradation value of the toner layer of each color in the lower toner layer portion (lower layer gradation value of the toner of each color) is not calculated.

According to Experiment 3 of Embodiment 2, the influence of the upper toner layer on the fixing-separation performance is about four times that of the lower toner layer, hence in Embodiment 3, the correction coefficient (weighting) of the lower toner layer is set to 0.25 with respect to the upper toner layer. In this way, the gradation value of the toner layer of each color is weighted higher than the gradation value of the toner layer of each color constituting the lower toner layer. In concrete terms, the video controller 30 performs weighting so that the weight of the gradation value of the toner layer of each color constituting the upper toner layer is larger than the weight of the gradation value of the toner layer of each color constituting the lower toner layer. Here the video controller 30 applies a weight of 1.0 to the gradation value of the toner layer of each color constituting the upper toner layer, and applies a weight of 0.25 to the gradation value of the toner layer of each color constituting the lower toner layer, but the weight values are not limited to these values. The values of the weight applied to the gradation value of the toner layer of each color constituting the upper toner layer and the gradation value of the toner layer of each color constituting the lower toner layer may be changed. Further, the video controller 30 may multiply the gradation value of the toner layer of each color constituting the lower toner layer by a predetermined value N1 ($0<N1<1.0$), or may divide the gradation value of the toner layer of each color constituting the lower toner layer by a predetermined value N2 ($1.0<N2$). Furthermore, the video controller 30 may subtract a predetermined value N3 ($0\%<N3<100\%$) from the gradation value of the toner layer of each color constituting the lower toner layer.

For the characteristic on the toner of each color, a storage elastic modulus G' at 100° C. of the toner of each color is used. In other words, the characteristic value of the toner is a value determined using the storage elastic modulus G' at 100° C. of the toner of each color. Using the following formula, the video controller 30 calculates the separation index S1 based on these values.

$$S2=\Sigma((Pi\times(Dti+Dbi\times 0.25))\ (i=Y, M, C, K) \qquad \text{Separation index}$$

Pi (i=Y, M, C, K): characteristic value of toner of each color
Dti (i=Y, M, C, K): gradation value of upper toner layer of each color
Dbi (i=Y, M, C, K): gradation value of lower toner layer of each color For example, FIG. 17A indicates the separation index S2 according to Embodiment 3 for the toner layer configuration used for Experiment 4 of Embodiment 2. In the case of the toner layer configuration (A) of FIG. 17A, the Y toner gradation value of the upper toner layer (value corresponding to the upper toner layer, out of the Y toner gradation values) is 80%, and the K toner gradation value of the upper toner layer (value corresponding to the upper toner layer, out of the K toner gradation values) is 40%. In the case of the toner layer configuration (A) in FIG. 17A, the K toner gradation value of the lower toner layer (value corresponding to the lower toner layer, out of the K toner gradation values) is 40%. In the case of the toner layer configuration (B) in FIG. 17B, the upper toner layer indicates the Y toner gradation value 40% and the K toner gradation value 80%, and the lower toner layer indicates the Y toner gradation value 40%. If the separation index S2 is calculated from these gradation values and the characteristic values of the toner, the separation index S2 of the image of the toner layer configuration (A) is 4.31, and the separation index S2 of the image of the toner layer configuration (B) is 4.79.

3-3 Operation Mode Determination Flow of Embodiment 3

Figure 18:
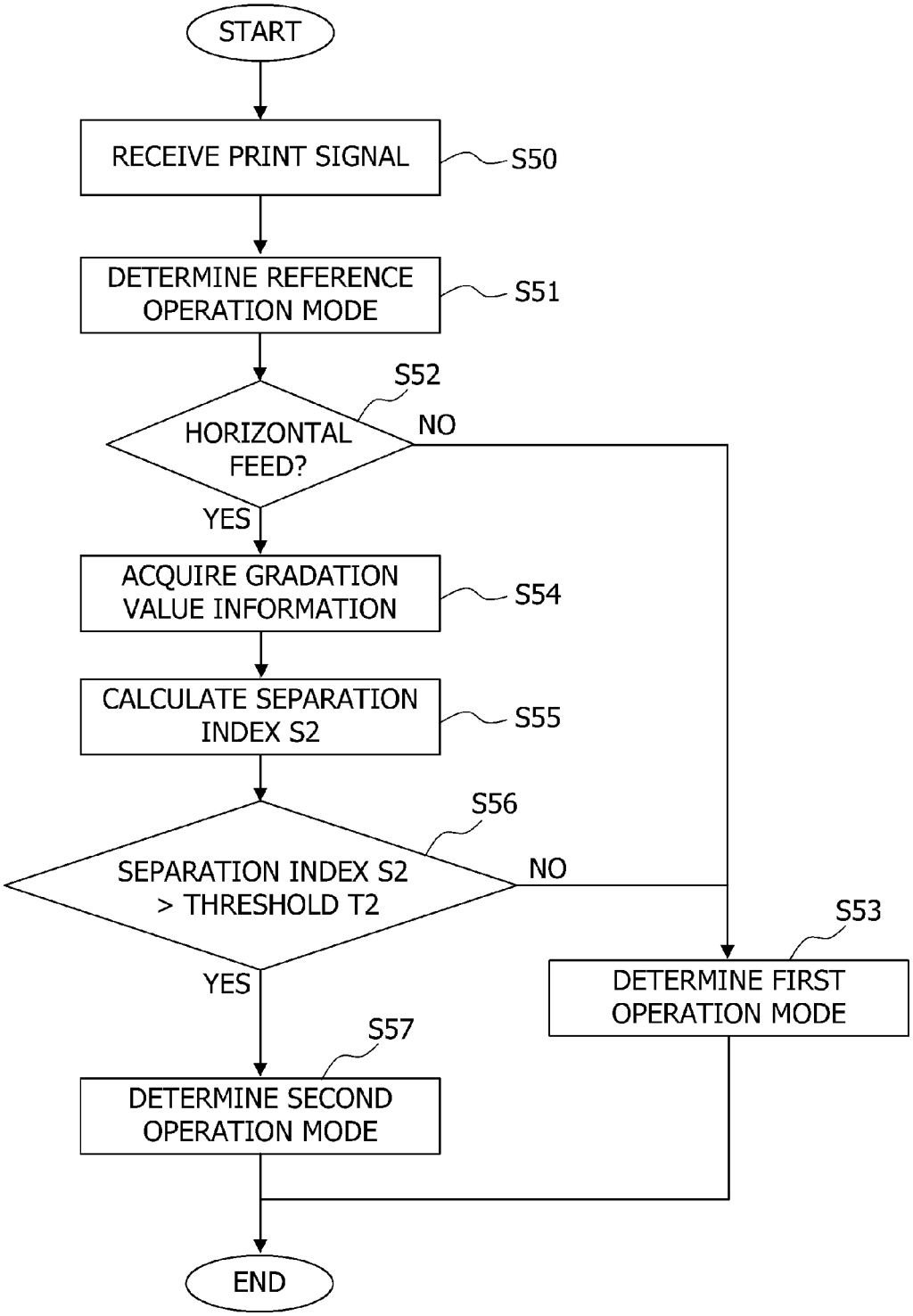
FIG. 18 is a flow chart depicting determination of an operation mode according to Embodiment 3.

In the image forming apparatus P and the fixing apparatus F according to Embodiment 3, the video controller 30 acquires gradation value information on a plurality of colors in the image region Zt, and calculates the separation index S2 using the acquired information and the toner characteristic values. Then the video controller 30 changes the target temperature and the processing speed (conveying speed of recording material S) of the image forming apparatus P. The print operation mode determination flow will be described with reference to the flow chart in FIG. 18.

The basic flow until the gradation value information on the image according to Embodiment 3 is acquired (S50 to S53) is the same as the flow (S20 to S23) of Embodiment 1, hence description thereof is omitted. Then based on the information received from the host computer, the video controller 30 acquires the gradation value information on the toner of each color in the image region Zt divided above (S54). In concrete terms, the video controller 30 acquires the gradation value of the toner of each color in the upper toner layer portion, and the gradation value of the toner of each color in the lower toner layer portion in the image region Zt. Then the video controller 30 calculates the separation index S2 based on the characteristic value of the toner of each color and the gradation value of the toner layer of each color in the upper toner layer portion, and the gradation value of the toner layer of each color in the lower toner layer portion (S55).

Then the video controller 30 determines whether the separation index S2 is larger than an arbitrary threshold T2 (5.1 in Embodiment 3) (S56). If the separation index S2 is the threshold T2 or less (S56: NO), the video controller 30 determines that the print operation mode is the first operation mode (S53). In concrete terms, the video controller 30 sets the processing speed to full speed (maximum speed), and sets the target temperature to the reference temperature. Then the print operation mode determination processing ends. If the separation index S2 is larger than the threshold T2 (S56: YES), the video controller 30 determines that the print operation mode is the second operation mode (S57). In concrete terms, the video controller 30 sets the processing speed to a speed slower than the reference processing speed (e.g. 50 mm/sec), and sets the target temperature to a temperature lower than the reference temperature by 20° C. Then the print operation mode determination processing ends. In this way, the video controller 30 compares the separation index S2 and the threshold T2 (second threshold), and determines the print operation mode based on the result of the comparison.

After the print operation mode determination processing ends, the controller 31 controls fixing of the toner image to the recording material S by the fixing apparatus F based on the processing speed (conveying speed of recording material S) which was set in S53 or S57. The controller 31 also controls the power to be supplied to the fixing apparatus F or the heater 23 based on the target temperature which was set in S53 or S57, so that the temperature of the fixing apparatus F or the temperature of the heater 23 maintains the target temperature.

3-4 Confirming Effect

Experiment 6

For Embodiment 3 and Embodiment 2, the occurrence of conveyance jams (Occurred/Not occurred) and the output time when printing is performed were confirmed. The image forming apparatus P, the fixing apparatus F and the recording material S which were used are the same as those used for Experiment 5 of Embodiment 2. The images to be printed are images (A), (C) and (E) where toner is laid on the image region Zt, out of the five types of images indicated in FIGS. 10A to 10E. FIGS. 19A to 19E indicate the gradation value information on the toner layer of each color and the separation index S2. Each of these images was printed continuously for ten prints using the image forming apparatus P of Embodiment 3 and the image forming apparatus P of Embodiment 1. Table 5 indicates the result of the occurrence of conveyance jams (Occurred/Not occurred) and the output time when printing is performed continuously for ten prints for the images (A), (C) and (E) in FIGS. 10A, 10C and 10E.

TABLE 5

| | Image (a) | Image (c) | Image (e) |
|---|---|---|---|
| Embodiment 3 | Not occurred/ 35 seconds | Not occurred/ 35 seconds | Not occurred/ 35 seconds |
| Embodiment 2 | Not occurred/ 35 seconds | Not occurred/ 35 seconds | Not occurred/ 112 seconds |

The separation index that enables fixing-separation when the target temperature is 200° C. is 5.4. In Embodiment 2, the threshold T1 to determine the separation index S2 is 4.5, considering the margin, such as the dispersion of the toner bearing amount on the recording materials S and the influence of the lower toner layer. Therefore in Embodiment 2, in the case of image (E) in FIG. 10E, it takes 112 seconds to print ten prints. In Embodiment 3, on the other hand, where the influence of the lower toner layer on the separation performance is corrected, the threshold T2, to determine the separation index S2, is 5.1, considering the margin of the dispersion of the toner bearing amount alone. Therefore in Embodiment 3, even in the case of printing the image (E) in FIG. 10E, the reference operation mode is set, and ten prints can be printed in 35 seconds.

In this way, according to Embodiment 3, the gradation value information is acquired for each toner layer of a plurality of colors in a page respectively. Then the processing speed (conveying speed of the recording material S) and the target temperature of the image forming apparatus P are controlled considering the influence of the upper toner layer on the contacting side to the fixing film 22 and the influence of the lower toner layer on the recording material S side, in accordance with the layer configuration of the toner image. Therefore an optimum fixing control can be selected in accordance with the image, and productivity can be improved while suppressing the occurrence of conveyance jams of the recording material S.

Modifications

Preferred embodiments of the present invention have been described, but the present invention is not limited to these embodiments, and may be modified and changed in various ways within the scope of the essence thereof.

Modification 1

In Embodiments 1 to 3 described above, the operation mode is selected depending on the feed direction of the recording material S, but the present invention is not limited to this, and the operation mode may be selected by specifying the paper type, the basis weight of paper and the like.

Modification 2

In Embodiments 1 to 3, the video controller 30 divides the image data into two regions in the conveying direction, and sets the region of 50 mm on the front end side of the recording material S as the image region Zt, and the region on the rear end side of the recording material S as the image region Zb. Further, in Embodiment 1 to 3, the video controller 30 acquires the gradation value information on the toner layers of a plurality of colors for the image region Zt. However, the present invention is not limited to this, and the video controller 30 may acquire the gradation value information on the toner layers of a plurality of colors for the image region Zt and the image region Zb respectively. The video controller 30 may acquire the gradation information on a plurality of colors for the image region Zt and the image region Zb respectively, and calculate a plurality of separation indexes S (S1 or S2) using the acquired information and the toner characteristic values. The video controller 30 may compare a plurality of separation indexes S and the threshold T (T1 or T2) respectively, and determine the target temperature and the target speed based on the result of the comparison. For example, in the case where at least one of the plurality of separation indexes S is larger than the threshold T, the video controller 30 may determine that the print operation mode is the second operation mode. The video controller 30 may acquire the gradation value information on the toner layers of a plurality of colors for at least one of the image region Zt and the image region Zb, and calculate at least one separation index S using the acquired information and the toner characteristic values. The video controller 30 may further divide the image data in the conveying direction, or set a plurality of regions by dividing the image data in the direction orthogonally to the conveying direction. The video controller 30 may acquire the gradation information on a plurality of colors of each of the plurality of divided regions, and calculate a plurality of separation indexes S using the acquired information and the toner characteristic values. The video controller 30 may compare a plurality of separation indexes S and the threshold T respectively, and determine the target temperature and the target speed based on the result of the comparison.

Modification 3

In Embodiment 1 to 3, the heater 23 is used for heating in the fixing apparatus F, but the present invention is not limited to this, and heating in the fixing apparatus F may be performed by an electromagnetic induction type excitation coil, for example.

Modification 4

In Embodiments 1 to 3, the processing speed (conveying speed of recording material S) is changed to the fixed speed, but the processing speed may be adjusted without steps in accordance with the gradation value information.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-095113, filed on May 21, 2019, which is hereby incorporated by reference herein in its entirety.

What is claimed is:

1. An image forming apparatus, comprising:

a fixing unit configured to fix, onto a recording material, a toner image that is formed in accordance with image data, and constituted of a first image that is formed by at least a toner of a first color and a second image that is formed by a toner of a second color which is different from the first color, and that is superimposed on the first image;

an acquiring unit configured to acquire at least information on a gradation value of the first image and information on a gradation value of the second image based on the image data;

a determining unit configured to determine a target temperature which is a temperature to fix the toner image to the recording material and target speed to convey the recording material, based on the information on the gradation value of the first image and the information on the gradation value of the second image; and a control unit configured to control power to be supplied to the fixing unit so that the temperature of the fixing unit maintains the target temperature, and to control a conveying speed of the recording material, which is conveyed by the fixing unit, based on the target speed.

2. The image forming apparatus according to claim 1, wherein the fixing unit is configured to fix a first toner image and a second toner image which is different from the first toner image, wherein the determining unit calculates information on a first value by adding information on the gradation value of the first image in the first toner image and information on the gradation value of the second image in the first toner image, determines the target temperature as a first temperature and determines the target speed as a first conveying speed based on the information on the first value, calculates information on a second value by adding information on the gradation value of the first image in the second toner image and information on the gradation value of the second image in the second toner image, determines the target temperature as second temperature which is lower than the first temperature, and determines the target speed as second conveying speed which is slower than the first conveying speed based on the information on the second value, and the information on the second value is larger than the information on the first value.

3. The image forming apparatus according to claim 1, wherein the acquiring unit acquires a characteristic value of the toner of the first color and a characteristic value of the toner of the second color, and the determining unit determines the target temperature which is a temperature to fix the toner image to the recording material, and the target speed to convey the recording material, based on the information on the gradation value of the first image, the information on the gradation value of the second image, the characteristic value of the toner of the first color, and the characteristic value of the toner of the second color.

4. The image forming apparatus according to claim 3, wherein the determining unit compares a total of adding a value calculated by multiplying the information on the gradation value of the first image by the characteristic value of the toner of the first color, and a value calculated by multiplying the information on the gradation value of the second image by the characteristic value of the second color with a threshold, and determines the target temperature and the target speed based on a result of the comparison.

5. The image forming apparatus according to claim 3, wherein the determining unit determines the target temperature and the target speed based on a total of adding a value calculated by multiplying the information on the gradation value of the first image by the characteristic value of the toner of the first color, and a value calculated by multiplying the information on the gradation value of the second image by the characteristic value of the toner of the second color.

6. The image forming apparatus according to claim 3, wherein the fixing unit includes a fixing member that comes into contact with the toner image formed on the recording material, and a pressing member that faces the fixing member and holds the recording material with the fixing member, and the first image and the second image are included in a first portion of the toner image on a side contacting to the fixing member.

7. The image forming apparatus according to claim 6, wherein the total of the information on the gradation value of the first image included in the first portion and the information on the gradation value of the second image included in the first portion is at least 80% and not more than 160%.

8. The image forming apparatus according to claim 6, wherein the first portion completely covers a surface of the recording material.

9. The image forming apparatus according to claim 6, wherein the first portion is a portion corresponding to a predetermined toner bearing amount per unit area.

10. The image forming apparatus according to claim 3, wherein the fixing unit includes a fixing member that comes into contact with the toner image formed on the recording material, and a pressing member that faces the fixing member and holds the recording material with the fixing member, and the first image and the second image are included in a first portion of the toner image which is a portion on a contacting side to the fixing member and is a portion corresponding to a predetermined toner bearing amount per unit area.

11. The image forming apparatus according to claim 3, wherein the fixing unit includes a fixing member that comes into contact with the toner image formed on the recording material, and a pressing member that faces the fixing member and holds the recording material with the fixing member, the second image is included in a first portion of the toner image on a contacting side to the fixing member, and the first image is included in the first portion and a second portion which is a remaining portion of the toner image other than the first portion, and the acquiring unit performs weighting for the information on the gradation value of the first image and the information on the gradation value of the second image respectively, and applies a larger weight to the information on the gradation value of the first image included in the first portion and the information on the gradation value of the second image included in the first portion, than to the information on the gradation value of the first image included in the second portion.

12. The image forming apparatus according to claim 3, wherein the characteristic value of the toner of the first color is a value determined using a storage elastic modulus of the toner of the first color, the characteristic value of the toner of the second color is a value determined using a storage elastic modulus of the toner of the second color, and the storage elastic modulus of the toner of the first color at 100° C. and the storage elastic modulus of the toner of the second color at 100° C. are different from each other.

13. The image forming apparatus according to claim 1, wherein the acquiring unit divides the image data into a plurality of regions, and acquires information on the gradation value of the first image and information on the gradation value of the second image for at least one of the plurality of regions.

14. The image forming apparatus according to claim 1, wherein in a case where a region of the image data at a front end side of the recording material in a conveying direction of the recording material is set as a first region and a region of the image data at a rear end side of the recording material in the conveying direction of the recording material is set as a second region, the information on the gradation value of the first image and the information on the gradation value of the second image is information corresponding to the first region.

15. The image forming apparatus according to claim 14, wherein the first image is formed by a cyan toner, and the second image is formed by a black toner.

16. An image forming method for an image forming apparatus including a fixing unit configured to fix, onto a recording material, a toner image that is formed in accordance with image data, and constituted of a first image that is formed by at least a toner of a first color and a second image that is formed by toner of a second color which is different from the first color, and that is superimposed on the first image, wherein a computer executes:

an acquiring step of acquiring at least information on a gradation value of the first image and information on a gradation value of the second image based on the image data;

a determining step of determining a target temperature, which is a temperature to fix the toner image to the recording material, and a target speed to convey the recording material, based on the information on the gradation value of the first image and the information on the gradation value of the second image; and a control step of controlling power to be supplied to the fixing unit so that the temperature of the fixing unit is maintained at the target temperature, and controlling a conveying speed of the recording material, which is conveyed by the fixing unit, based on the target speed.

17. A computer readable recording medium recording a program to cause a computer to execute each step of an image forming method for an image forming apparatus including a fixing unit configured to fix, onto a recording material, a toner image that is formed in accordance with image data, and constituted of a first image that is formed by at least a toner of a first color and a second image that is formed by toner of a second color, which is different from the first color, and that is superimposed on the first image, wherein the program causes the computer executes:

an acquiring step of acquiring at least information on a gradation value of the first image and information on a gradation value of the second image based on the image data;

a determining step of determining a target temperature, which is a temperature to fix the toner image to the recording material, and a target speed to convey the recording material, based on the information on the gradation value of the first image and the information on the gradation value of the second image; and a control step of controlling power to be supplied to the fixing unit so that the temperature of the fixing unit is maintained at the target temperature, and controlling a conveying speed of the recording material, which is conveyed by the fixing unit, based on the target speed.

18. An image forming apparatus, comprising:

a fixing unit configured to fix, onto a recording material, a toner image that is formed in accordance with image data, and constituted of a first image that is formed by at least a toner of a first color and a second image that is formed by a toner of a second color which is different from the first color, and that is superimposed on the first image;

an acquiring unit configured to acquire at least a density value of the first image and a density value of the second image based on the image data; and a determining unit configured to determine a target temperature which is a temperature to fix the toner image to the recording material and a target speed to convey the recording material, based on the density value of the first image and the density value of the second image;

wherein in a case an image forming region at a front end side of the recording material in a conveying direction of the recording material is set as a first region and an image forming region at a rear end side of the recording material in a conveying direction of the recording material is set as a second region, the determining unit is configured to when a value which is calculated by adding the density value of the first image at the first region to the density value of the second image at the first region is a first value, determine the target temperature as a first temperature, and determine the target speed as a first conveying speed, when a value which is calculated by adding the density value of the first image at the first region to the density value of the second image at the first region is a second value, determine the target temperature as second temperature which is lower than the first temperature, and determine the target speed as second conveying speed which is slower than the first conveying speed, and the second value is larger than the first value.

19. An image forming apparatus, comprising:

a fixing unit configured to fix, onto a recording material, a toner image that is formed in accordance with image data, and constituted of a first image that is formed by at least a toner of a first color and a second image that is formed by a toner of a second color which is different from the first color, and that is superimposed on the first image;

an acquiring unit configured to acquire at least a density value of the first image and a density value of the second image based on the image data; and a determining unit configured to determine a target temperature which is a temperature to fix the toner image to the recording material and a target speed to convey the recording material, based on the density value of the first image and the density value of the second image;

wherein the determining unit is configured to when a value which is calculated by adding the density value of the first image at a front end side region which is an image forming region at a front end side of the recording material in a conveying direction of the recording material to the density value of the second image at the front end side region is a first value, determine the target temperature as a first temperature, and determine the target speed as a first conveying speed, when a value which is calculated by adding the density value of the first image at the front end side region to the density value of the second image at the front end side region is a second value, determine the target temperature as a second temperature which is lower than the first temperature, and determine the target speed as a second conveying speed which is slower than the first conveying speed, and the second value is larger than the first value.

20. The image forming apparatus according to claim 19, wherein the first image is formed by a cyan toner, and the second image is formed by a black toner.

21. The image forming apparatus according to claim 19, wherein information on a gradation value of the first image and information on a gradation value of the second image is information corresponding to the front end side region.

* * * * *